US007090146B1

(12) United States Patent
Ericksen et al.

(10) Patent No.: US 7,090,146 B1
(45) Date of Patent: Aug. 15, 2006

(54) ABOVE-GROUND ADJUSTABLE SPRAY PATTERN SPRINKLER

(75) Inventors: Kent C. Ericksen, North Salt Lake, UT (US); Alan John Smith, Bountiful, UT (US)

(73) Assignee: Orbit Irrigation Products, Inc., Bountiful, UT (US)

( * ) Notice: Subject to any disclaimer, the term of this patent is extended or adjusted under 35 U.S.C. 154(b) by 210 days.

(21) Appl. No.: 10/806,794

(22) Filed: Mar. 23, 2004

(51) Int. Cl.
*B05B 15/10* (2006.01)

(52) U.S. Cl. ..... 239/200; 239/201; 239/202; 239/203; 239/204; 239/206

(58) Field of Classification Search ..... 239/200, 239/201, 202, 203, 204, 206, 233, 237, 240, 239/242, 247, 255
See application file for complete search history.

(56) References Cited

U.S. PATENT DOCUMENTS

| | | | | |
|---|---|---|---|---|
| 1,871,258 | A | 8/1932 | Coles et al. | |
| 2,313,994 | A | 3/1943 | Grant | |
| 2,726,119 | A | 12/1955 | Egly et al. | |
| 3,033,467 | A | 5/1962 | Hofer | |
| 3,038,666 | A | 6/1962 | Dudley et al. | |
| 3,094,283 | A | 6/1963 | Balister | |
| 3,149,784 | A | 9/1964 | Skidgel | |
| 3,383,047 | A | 5/1968 | Hauser | |
| 3,645,451 | A | 2/1972 | Hauser | |
| 3,655,132 | A | 4/1972 | Rosic | |
| 3,758,038 | A | 9/1973 | Ridgway | |
| 3,785,565 | A | 1/1974 | Perry et al. | |
| 3,878,990 | A | 4/1975 | Geraudie | |
| 3,915,383 | A | 10/1975 | King | |
| 3,921,912 | A | 11/1975 | Hayes | |
| 3,934,820 | A | 1/1976 | Phaup | |
| 3,998,390 | A | 12/1976 | Peterson et al. | |
| 4,069,976 | A | 1/1978 | Chauvigne | |
| D250,769 | S | 1/1979 | Dadson | |
| D254,087 | S | 1/1980 | Dadson | |
| 4,201,344 | A | 5/1980 | Lichte | |
| 4,235,379 | A | 11/1980 | Beamer | |
| 4,253,608 | A | 3/1981 | Hunter | |
| 4,335,852 | A | 6/1982 | Chow | |
| 4,471,908 | A * | 9/1984 | Hunter | 239/11 |
| D277,777 | S | 2/1985 | Lemkin | |
| D282,769 | S | 2/1986 | Lemkin et al. | |
| 4,597,528 | A | 7/1986 | Caruana | |

(Continued)

FOREIGN PATENT DOCUMENTS

| | | |
|---|---|---|
| EP | 142260 | 7/1987 |

(Continued)

*Primary Examiner*—Davis Hwu
(74) *Attorney, Agent, or Firm*—Madson & Austin

(57) ABSTRACT

An above-ground sprinkler may have a head that rotates about an angle determined by the relative angles between a pair of arc adjustment rings. Rotation of the head may be driven by a drive mechanism with a rotor rotationally driven by fluid flowing to the head. The drive mechanism may have a valve disposable in two positions to control flow to the rotor to determine the direction in which the rotor rotates. A reduction gear drive may transmit torque from the rotor to the head to cause the head to rotate. The head may have a cover with an outlet aperture and a flow control member that rotates within the cover to dispose any of a plurality of nozzles in alignment with the outlet aperture. A deflection screw or a slider with a plurality of deflectors may be used to provide variable deflection of water sprayed from the outlet aperture.

46 Claims, 8 Drawing Sheets

U.S. PATENT DOCUMENTS

| | | | | |
|---|---|---|---|---|
| 4,624,412 | A | | 11/1986 | Hunter |
| 4,625,914 | A | | 12/1986 | Sexton et al. |
| 4,708,290 | A | | 11/1987 | Osmond |
| D297,042 | S | | 8/1988 | Evans |
| D297,255 | S | | 8/1988 | Henken |
| 4,773,595 | A | | 9/1988 | Livne |
| 4,867,378 | A | | 9/1989 | Kah, Jr. |
| D305,791 | S | | 1/1990 | Lang |
| D305,792 | S | | 1/1990 | Hastings et al. |
| D305,925 | S | | 2/1990 | Hastings et al. |
| D309,772 | S | | 8/1990 | Hastings et al. |
| 5,031,833 | A | | 7/1991 | Alkalay et al. |
| 5,052,621 | A | | 10/1991 | Katzer et al. |
| 5,086,977 | A | * | 2/1992 | Kah, Jr. ..... 239/205 |
| 5,115,977 | A | | 5/1992 | Alkalay et al. |
| 5,226,599 | A | | 7/1993 | Lindermeir et al. |
| 5,526,982 | A | | 6/1996 | McKenzie |
| 5,611,488 | A | | 3/1997 | Frolich |
| 5,746,374 | A | | 5/1998 | Simonetti et al. |
| 5,765,757 | A | | 6/1998 | Bendall |
| 5,769,322 | A | | 6/1998 | Smith |
| 5,826,797 | A | | 10/1998 | Kah, III |
| 6,085,995 | A | | 7/2000 | Kah, Jr. et al. |
| 6,138,924 | A | * | 10/2000 | Hunter et al. ..... 239/204 |
| 6,182,909 | B1 | | 2/2001 | Kah, Jr. et al. |
| 6,237,862 | B1 | | 5/2001 | Kah, III et al. |
| 6,601,781 | B1 | | 8/2003 | Kah, III et al. |

FOREIGN PATENT DOCUMENTS

| | | |
|---|---|---|
| EP | 153129 | 7/1988 |
| EP | 826427 | 1/1999 |

* cited by examiner

ABOVE-GROUND ADJUSTABLE SPRAY PATTERN SPRINKLER

BACKGROUND OF THE INVENTION

1. Field of the Invention

The present invention relates to systems and methods for irrigating soil. More specifically, the present invention relates to an above-ground sprinkler head and related methods that distribute water over a variable spray pattern.

2. Description of Related Art

Irrigation not only permits foodstuffs to be grown, but also enables the cultivation of attractive plant life that otherwise would not have sufficient water to thrive. Many households now utilize sprinkler systems to provide irrigation in a comparatively uniform and trouble-free manner.

Above-ground sprinklers may be used to provide flexible irrigation. For example, an above-ground sprinkler may be attached to an ordinary garden hose and then placed in a desired location to provide irrigation. Above-ground sprinklers may be used to supplement existing, in-ground systems by providing additional irrigation in places that are not sufficiently watered by the in-ground system. Alternatively, above-ground sprinklers may be used as the sole source of irrigation water for an area.

A single above-ground sprinkler may be moved from one location to another and activated in each location for a certain length of time to provide the desired level of irrigation. Alternatively, multiple above-ground sprinklers may be positioned and activated simultaneously or in sequence, either manually or via timed valve systems.

Unfortunately, known above-ground sprinklers have a number of limitations. For example, many existing above-ground sprinklers can only distribute water from the nozzle according to one spray pattern. Accordingly, the flow rate, range, and/or other water distribution properties may not be adjustable.

Many known above-ground sprinklers are not able to provide an adjustable spray angle. Of those that do provide an adjustable spray angle, many are relatively complex in design, and have a high part count. Accordingly, such sprinklers are generally expensive, difficult to manufacture, and/or prone to failure.

SUMMARY OF THE INVENTION

The apparatus of the present invention has been developed in response to the present state of the art, and in particular, in response to the problems and needs in the art that have not yet been fully solved by currently available irrigation systems and components. Thus, it is an overall objective of the present invention to provide irrigation systems and sprinklers that remedy the shortcomings of the prior art.

To achieve the foregoing objective, and in accordance with the invention as embodied and broadly described herein in one embodiment, an irrigation system is used to irrigate an area. The irrigation system is disposed above-ground to permit easy installation and flexible operation. The irrigation system may be attachable to a standard spigot. The irrigation system has a valving system designed to control flows of an irrigation liquid, such as water, from the spigot to a plurality of water distribution units such as sprinkler assemblies. The valving system has a plurality of valve assemblies capable of independently controlling flows of the irrigation liquid. Each valve assembly is coupled to one or more sprinkler assemblies via a conduit, which may take the form of a hose such as a standard garden hose.

Each valve assembly has a valve and a wire or group of wires that conveys a valve activation signal to the valve to move the valve assembly between open and closed configurations. The valves may be connected together and connected to the spigot via a junction. The valving system has a control unit in the form of a timer that is electrically connected to each of the valve wires.

Each of the sprinkler assemblies may be designed for portable, above-ground use, and may thus include a base and a sprinkler. The base may be generally horizontal, with feet to provide stability, or vertical, with a spike driven into the ground. Each sprinkler may be designed to provide irrigation through an adjustable angle, and may distribute water in an adjustable spray pattern through the use of a system of switchable flow control features such as nozzles or deflectors.

In one embodiment, each sprinkler has a head, a body, first and second arc adjustment rings, an inlet plate, and an inlet shaft. The sprinkler may be oriented generally vertically, with the inlet plate on the bottom and the adjustment rings, the body, and the head arranged above the inlet plate, in that order. The inlet shaft extends through the inlet plate and the adjustment rings to convey water to the body. The sprinkler has a drive mechanism of which the adjustment rings are a part. The drive mechanism is driven by water flow and causes the head and body to rotate with respect to the inlet plate about an angle established by the relative positions of the adjustment rings.

The head includes a cover, a flow control member disposed within the cover, and a deflection screw. The cover has a generally tubular shape with an outer wall having an outlet aperture through which water is sprayed from the head. The cover also has an enclosure disposed around the outlet aperture. The adjustment screw extends into the enclosure and is threaded in such a manner that rotation of the adjustment screw controls the degree to which the adjustment screw protrudes into the flow of water sprayed from the outlet aperture.

The flow control member has an outer wall coaxial with that of the cover. A plurality of nozzles is formed in the outer wall. Each nozzle is positioned such that rotation of the flow control member within the cover aligns one of the nozzles with the outlet aperture. The flow control member has a dial that protrudes upward from the cover so that a user can manually grip the dial and rotate it to align the desired nozzle with the outlet aperture. The body also has a generally tubular shape with an outer wall that contains a portion of the drive mechanism. Each of the adjustment rings has a lever that may easily be grasped to rotate the adjustment ring to facilitate adjustment of the angle through which water is sprayed from the head.

The drive mechanism of the sprinkler has a first portion disposed generally within the cover of the head. The first portion includes a first rotor enclosure plate, a rotor, a bushing, a spindle, and a second rotor enclosure plate. The rotor is rotatably captured between the first and second rotor enclosure plates by the bushing and the spindle.

The flow control member may have a number of nozzles, and in one embodiment, includes eight nozzles. Each of the nozzles includes at least one orifice; the orifices include a variety of shapes so that the nozzles provide a variety of spray patterns. The outer wall of the flow control member has annular notches on either side of the nozzles. O-rings are disposed in the annular notches so that water exiting the nozzles is restricted from flowing out of the annular gap between the cover and the flow control member. The flow control member has a detent mechanism comprising a detent flange with a plurality of curved tabs that extend outward. The curved tabs are able to engage notches formed in an annular ring extending inward from the cover, thereby urging the flow control member to remain in the orientations in which a nozzle is aligned with the outlet aperture.

The second rotor enclosure plate has first and second openings that convey water to the rotor. The first opening conveys water along one direction so that the rotor spins clockwise, as viewed from above, and the second opening conveys water along another direction to spin the rotor counterclockwise. The spindle has a gear that extends downward through the second rotor enclosure plate to convey torque from the rotor to a second portion of the drive mechanism. After impinging against the rotor, the water flows through an outlet opening in the first rotor enclosure plate. The water enters a plenum chamber within the flow control member and moves into the nozzles from the plenum chamber.

The second portion of the drive mechanism is disposed generally within the body, and includes a reduction gear train and a valve. The reduction gear train includes a plurality of gears and an output gear unit. The gears receive torque from the rotor via the gear of the spindle. The gears transmit the torque to the output gear unit. The gears and the output gear unit cooperate to provide a positive mechanical advantage so that the output gear unit has a low rate of rotation and a high torque compared to the rotor.

The body has a shaft designed to receive some of the gears, and a socket that receives the output gear unit. The output gear unit has a shaft that also receives some of the gears, and teeth that mesh with the gears to receive torque from the gears. Additionally, the output gear unit has an output gear that extends through the socket of the body to provide torque. The body also has a central hole with threads that mate with corresponding threads of the inlet shaft. Additionally, the body has a valve retainer with an opening and a lip that encircles the opening.

The valve includes a rocker, an over-center spring, and a post. The rocker has first and second cover plates, and pivot tabs that pivotably abut the second rotor enclosure plate. The rocker is thus able to pivot such that either the first cover plate covers the first hole of the second rotor enclosure plate, or the second cover plate covers the second hole of the second rotor enclosure plate. The post has an anchor that rests in the valve retainer and a shank that extends through the opening of the valve retainer. The post is coupled to the rocker by the over-center spring in such a manner that the over-center spring is compressed. The valve is therefore forced into one of two positions so that one of the first and second openings is always covered and the other is always open. The position of the valve determines which way the rotor rotates.

The output gear of the output gear unit conveys torque to a third portion of the drive mechanism. The third portion of the drive mechanism includes a clutch mechanism in addition to the arc adjustment rings. The clutch mechanism includes a collar, a spring, and a driving collar. The collar and the spring are disposed within the driving collar in such a manner that the collar is pressed outward from the driving collar.

The driving collar has teeth that mesh with the output gear of the output gear unit. The clutch mechanism is seated against the body in such a manner that the collar is pressed against the body by the spring. The driving collar has an opening through which the inlet shaft is disposed. The opening is encircled by radial teeth that extend outward (e.g., radially) from the opening on the outside of the driving collar.

Each of the adjustment rings has an outer ring and an inner ring coupled to the outer ring by a bridge. The first and second levers extend from the outer rings of the first and second adjustment rings. The outer ring, inner ring, and bridge of each adjustment ring cooperate to define an arcuate slot. A ridge protrudes inward from each inner ring.

The inlet plate has an outer wall with a generally tubular shape. The inlet plate also has a socket disposed inward of and coaxial with the outer wall. The socket extends upward through the inner rings of the first and second adjustment rings. The socket has exterior ridges that mesh with the ridges of the inner rings of the first and second arc adjustment rings in such a manner that the adjustment rings tend to rotate about the socket along discrete angles such as every 10°.

The socket also has radial teeth that mesh with the radial teeth of the driving collar in such a manner that the driving collar generally does not rotate with respect to the socket. However, the clutching operation of the clutch mechanism enables the driving collar to retract to allow the radial teeth of the driving collar to disengage from those of the socket via compression of the spring of the clutch mechanism. Accordingly, if a person attempts to force the body to rotate with respect to the inlet plate, relative rotation is able to occur and damage to the sprinkler is avoided. When the rotational force is removed, the spring presses the driving collar back into engagement with the socket to permit continued operation of the sprinkler.

The socket has an opening encircled by the radial teeth of the socket to permit passage of the inlet shaft. The inlet plate also has an inlet coupling that extends downward. The inlet coupling has male threads designed to permit the inlet coupling to mate with the sprinkler coupling of the corresponding base. The inlet shaft extends through the inlet coupling and is threaded into the central hole of the body in such a manner that the inlet shaft keeps the body, arc adjustment rings, and inlet plate attached together.

In operation, the water flows into the sprinkler through the inlet shaft, and into the body. The water flows through the reduction gear train and into whichever of the first and second openings is exposed by the valve. The water impinges against the rotor to drive rotation of the rotor, and flows into the plenum chamber. The water is then ejected from the nozzle aligned with the outlet aperture.

Rotation of the rotor is conveyed to the reduction gear drive, which provides the positive mechanical advantage. The reduction gear drive causes the body to rotate with respect to the driving collar of the clutch mechanism, thereby causing the head to rotate. When the head reaches one end of its arc, a bridge of one of the arc adjustment rings contacts the post of the valve to switch the position of the valve, thereby causing the head to reverse its direction of rotation. The relative positions of the arc adjustment rings thus establish the magnitude of the angle through which the head rotates.

The various parts described above may be formed of plastic materials, except for the o-rings, which may be formed of polymers. The parts may be assembled substantially without fasteners. Rather, the inlet shaft may be used to keep the body, arc adjustment rings, and inlet plate together. The first and second rotor enclosure plates may be coupled to the body via integrally formed snapping tabs to enclose the rotor and retain the spindle and bushing. The valve and the reduction gear train are kept in place within the body by the second rotor enclosure plate. The cover may be attached to the body via press fitting to keep the flow control member in place.

According to one alternative embodiment of the invention, the head of the sprinkler may be configured differently from that of the previous embodiment, while the remaining components may be substantially the same. More precisely, the head has a cover that fits directly over the body, and a flow control member disposed on top of the cover. The head also has a cap disposed on the flow control member to cover the flow control member, in such a manner that the flow control member is generally contained between the cover and the cap.

The cover has a plate disposed generally horizontally and a shaft extending from the plate. An outlet aperture is formed in the plate and surrounded by an o-ring. The flow control member has a plate disposed adjacent to the plate of the cover. The plate has a central opening through which the shaft extends. A plurality of extension tubes extend from the plate to a plurality of nozzles. The extension tubes extend upward and outward, with respect to the axis of the sprinkler, so that each of the nozzles is oriented along an inclined angle. The cap has an outer wall with a generally frusto-conical shape with which the nozzles are substantially flush.

The flow control member and cap are rotatable with respect to the cover to align each of the extension tubes with the outlet aperture, thereby permitting water to be sprayed from the associated nozzle. A dial may be disposed on the flow control member to facilitate rotation of the flow control member by hand. A detent mechanism operates to urge the flow control member to remain in those orientations at which one of the extension tubes is aligned with the outlet aperture.

Operation of the sprinkler is similar to that of the previous embodiment. The angle of rotation of the sprinkler head is established via relative rotation of the arc adjustment rings. The desired nozzle is selected by gripping the dial and rotating the flow control member and the cap until the desired nozzle is aligned with the outlet aperture. Water drives oscillating rotation of the body and head of the sprinkler through the selected angle, and the water is sprayed through the selected nozzle.

The sprinkler may be fabricated according to methods similar to those described in connection with the previous embodiment. For example, the head, flow control member, and cap may be manufactured via injection molding or the like. The cover, flow control member, and head may be assembled and retained together via an attachment screw. The cover may be press fit into engagement with the body after the various drive mechanism components have been assembled with the body, inlet shaft, inlet plate, and arc adjustment rings.

According to another alternative embodiment, a deflector flow control member is added to the previous embodiment. The deflector flow control member fits over the cap and is rotatable with respect thereto. The deflector flow control member has a plurality of openings, each of which can be rotated into alignment with the selected nozzle. Each of the openings has a deflector. The deflectors may have a variety of different shapes so that variable deflection can be applied to the water stream exiting the nozzle. Another detent mechanism may operate between the cap and the deflector flow control member to urge the deflector flow control member to remain in the positions in which one of the openings is aligned with the selected nozzle.

Operation of this embodiment is similar to that of the previous embodiment, except that the deflector flow control member can also be rotated to control deflection of the stream. Accordingly, the spray characteristics of the sprinkler are adjustable beyond those of the previous embodiment. Manufacture of the sprinkler is also similar to that of the previous embodiment. The deflector flow control member may be manufactured via injection molding or other processes. After the remaining components of the sprinkler have been assembled, the deflector flow control member may be rotatably coupled to the cap via the attachment screw.

Through the use of the irrigation systems, sprinklers, and associated methods of the present invention, above-ground sprinklers may be used to provide irrigation with enhanced flexibility and ease of use. Furthermore, such above-ground sprinklers may be economical and reliable in operation. These and other features and advantages of the present invention will become more fully apparent from the following description and appended claims, or may be learned by the practice of the invention as set forth hereinafter.

BRIEF DESCRIPTION OF THE DRAWINGS

A particular description of the invention will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 8, is not intended to limit the scope of the invention, as claimed, but is merely representative of presently preferred embodiments of the invention.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The phrase "attached directly to" refers to a form of attachment by which the attached items are either in direct contact, or are only separated by a single fastener, adhesive, or other attachment mechanism. The term "abutting" refers to items that are in direct physical contact with each other, although the items may not be attached together. The terms "integrally formed" refer to a body that is manufactured unitarily, i.e., as a single piece, without requiring the assembly of multiple pieces. Multiple parts may be integrally formed with each other if they are formed from a single workpiece.

Figure 1:
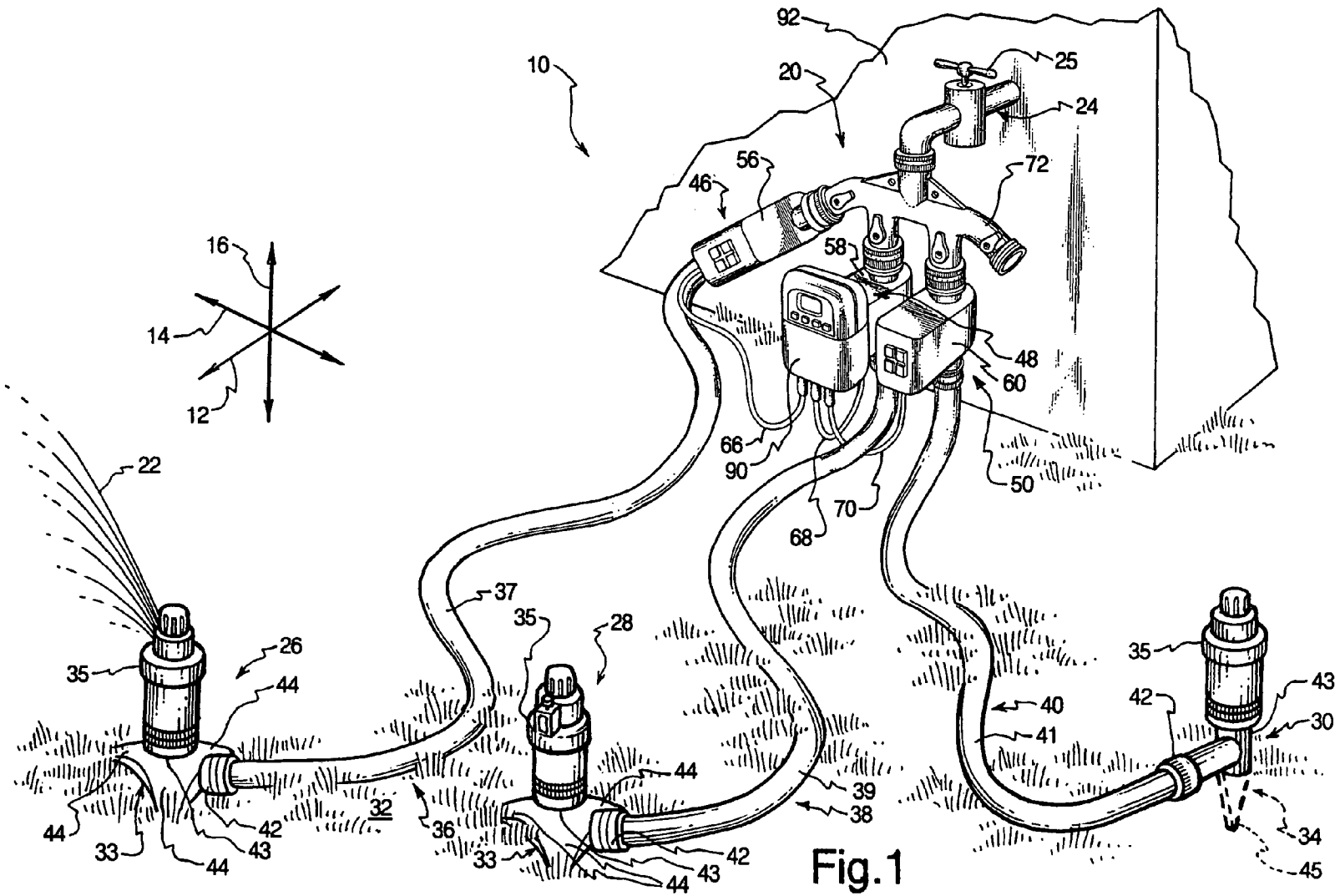
FIG. 1 is a perspective view of an irrigation system according to one embodiment of the invention.

Referring to FIG. 1, a perspective view depicts an irrigation system 10 according to one embodiment of the invention. The irrigation system 10 has a longitudinal direction 12, a lateral direction 14, and a transverse direction 16. The irrigation system 10 incorporates a valving system 20, which will be described in greater detail subsequently.

The irrigation system 10 is designed to receive water 22 from a spigot 24. The spigot 24 may be a standard garden spigot, and may have a handle 25 rotatable by a user to turn water flow through the spigot 24 on or off. In this application, "water" need not be pure water, but may, for example, include fertilizers, pesticides, or other additives. Such additives may be supplied through the inclusion of additional implements in the irrigation system 10, as known in the art.

The water 22 is distributed by a plurality of water distribution units over a patch of land designated for plant growth. "Water distribution unit" encompasses a variety of devices used to spread water, such as portable above-ground sprinklers, pop-up sprinkler heads, rotary sprinklers, bubblers, drip irrigation systems, and the like. The irrigation system 10 includes a first sprinkler assembly 26, a second sprinkler assembly 28, and a third sprinkler assembly 30. The sprinkler assemblies 26, 28, 30 comprise portable above-ground sprinklers and are arrayed to irrigate an area 32.

Each of the first and second sprinkler assemblies 26, 28 may have a base 33 with a generally flat, horizontal design. The third sprinkler assembly 30 may have a base 34 with a generally vertical design. Each of the sprinkler assemblies 26, 28, 30 also has a sprinkler 35 that distributes water over the area 32 along an adjustable arc, with an adjustable spray pattern.

The first sprinkler assembly 26 is supplied with water by a first conduit 36, which may take the form of a first hose 37. The first hose 37 may be a standard garden hose or the like. As shown, one end of the first hose 37 is coupled to the first sprinkler assembly 26. Similarly, the second sprinkler assembly 28 is supplied by a second conduit 38, which may be a second hose 39. The third sprinkler assembly 30 is supplied by a third conduit 40, which may be a third hose 41. If desired, additional hoses or other conduits may extend further from the sprinkler assemblies 26, 28, 30 to supply additional sprinkler assemblies (not shown). Alternatively, a branching hose or intermediate hose coupling may be used to connect multiple sprinkler assemblies in parallel.

Each of the bases 33, 34 of the sprinkler assemblies 26, 28, 30 has a garden hose coupling 42 to which the associated hose 37, 39, or 41 is attached. Each of the garden hose couplings 42 may thus have female threads (not shown) of the size typically used to receive a threaded male garden hose end. Each of the bases 33, 34 also has a sprinkler coupling 43, which may also have female threads (not shown). The sprinkler couplings 43 are designed to permit threaded attachment of the sprinklers 35 to the bases 33, 34. In alternative embodiments, quick-connect couplings or the like may be used in place of the sprinkler couplings 43.

Each of the bases 33 has a plurality of feet 44 that keep the first and second sprinkler assemblies 26, 28 relatively stable during irrigation. The base 34 has a spike 45 which may be driven into the ground to keep the third sprinkler assembly 30 stable during irrigation. In the alternative to the exemplary bases 33, 34 shown in FIG. 1, a wide range of base designs may be used, as known in the art.

Water flow to the first, second, and third hoses 37, 39, 41 is controlled by a first valve assembly 46, a second valve assembly 48, and a third valve assembly 50, respectively. The valve assemblies 46, 48, 50 may optionally operate to permit water flow to only one of the hoses 37, 39, 41 at any given time, so that each hose 37, 39, 41, in turn, receives the full pressure and flow rate of water from the spigot 24.

As depicted in FIG. 1, the first valve assembly 46 is in the open configuration to supply water to the first sprinkler assembly 26 via the first hose 37. The second and third valve assemblies 48, 50 are in the closed configuration so no significant amount of water flows into the second and third hoses 39, 41, and the second and third sprinkler assemblies 28, 30 are inactive.

The first, second, and third valve assemblies 46, 48, 50 include first, second, and third valves 56, 58, 60, respectively. Each of the valves 56, 58, 60 contains an obstruction member (not visible) that is movable by an electrically driven actuator (also not visible) to block or unblock water flow through the valve 56, 58, 60. Thus, each valve assembly 46, 48, 50 has a closed configuration, in which water flow is blocked, and an open configuration, in which water flow is comparatively freely permitted.

The first, second, and third valve assemblies 46, 48, 50 also include a first valve wire 66, a second valve wire 68, and a third valve wire 70, respectively. Each of the valve wires 66, 68, 70 may include multiple insulated conductors. Each of the valve wires 66, 68, 70 is coupled to the corresponding valve 56, 58, 60 in such a manner that an activation signal conveyed through any of the valve wires 66, 68, or 70 is able to trigger operation of the corresponding valve 56, 58, or 60.

In this application, the term "valve" is not limited to any specific design, but may include a combination of any actuator with any movable flow path obstruction mechanism. Thus, a valve may be any device that can selectively block and unblock a flow of fluid in response to receipt of an electric signal.

The valve assemblies 46, 48, 50 may be interconnected and coupled to the spigot 24 by a junction 72. The junction 72 enables water to flow from the spigot 24 to any of the valve assemblies 46, 48, 50. The valve assemblies 46, 48, 50 are electrically controlled by a control unit, which may take the form of a timer 90, as illustrated in FIG. 1. The timer 90 transmits the valve activation signals to the valves 56, 58, 60 via the valve wires 66, 68, 70 according to a schedule established by a user. The timer 90 may be attached to one of the valves 56, 58, 60, or may alternatively be attached to a wall 92 proximate the spigot 24.

The phrase "control unit" is not limited to a timer, but may include any other device that transmits a valve activation signal. Such devices include simple switches, remote receivers, control system processors designed to measure variables and control operation of the irrigation system 10 based on those variables, and the like.

The irrigation system 10 of FIG. 1 is merely exemplary. The teachings of the present invention may be applied to a variety of irrigation system types. In alternative embodiments, some irrigation system components may be buried underground and/or coupled to other water sources besides the spigot 24 of FIG. 1. More rigid conduits, such as PVC piping, or other types of conduits such as irrigation flexipipe may be used in place of the hoses 37, 39, 41. The configuration and operation of the sprinklers 35 will be shown and described in greater detail in connection with FIGS. 2 through 5, as follows.

Figure 2:
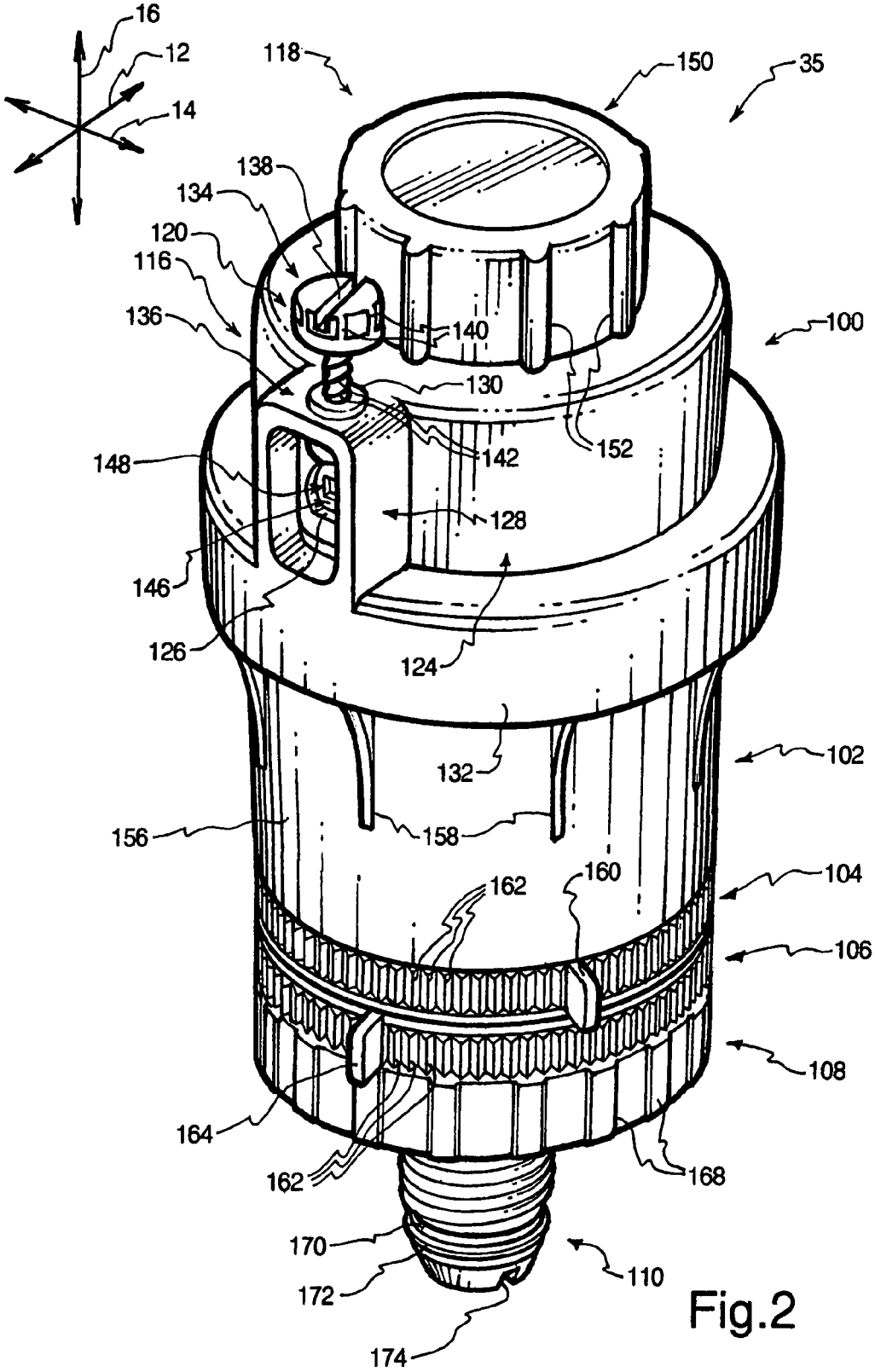
FIG. 2 is a perspective view of a sprinkler of one of the sprinkler assemblies of the irrigation system of FIG. 1.

Referring to FIG. 2, a perspective view illustrates one of the sprinklers 35 of FIG. 1 in isolation. As shown, the sprinkler 35 is oriented generally vertically, i.e., along a generally vertical axis, or along the transverse direction 16. In this application the phrase "generally vertical axis" refers to an axis of symmetry of the sprinkler 35 that is vertical or nearly vertical, for example, within thirty degrees of a vertical disposition.

The sprinkler 35 is designed to spray a relatively narrow stream of water along a direction that rotates through an angle to water a region with a shape that is generally circular or sectorial. The angle of the region irrigated by the sprinkler 35 is adjustable between a minimum angle, such as about 20°, and a maximum angle, such as substantially full-circle (360°). The sprinkler 35 also sprays the water with an adjustable spray pattern, which may include an adjustable spray distance.

As illustrated in FIG. 2, the sprinkler 35 has a head 100, a body 102, a first arc adjustment ring 104, a second arc adjustment ring 106, an inlet plate 108, and an inlet shaft 110. The first and second arc adjustment rings 104, 106 are rotatable with respect to the inlet plate 108 to establish the angle of the region irrigated by the sprinkler 35. Water enters the sprinkler 35 from the base 33 or 34 through the inlet shaft 110, which extends through the inlet plate 108 to the body 102. Water is conveyed from the body 102 to the head 100 and the head 100 and body 102 rotate through the angle as water is sprayed from the head 100.

As shown, the head 100 has a cover 116 with a generally tubular shape. The head 100 also has a flow control member 118 with a generally tubular shape; the flow control member 118 is rotatably disposed within the cover 116. Additionally, the head 100 has a deflection screw 120 that threadably engages the cover 116 to adjustably deflect water exiting the head 100.

The cover 116 has an outer wall 124 in which an outlet aperture 126 is formed. The outlet aperture 126 may have any known shape, but is shown with a generally circular shape, by way of illustration. As used in this application, the term "cover" does not necessarily require exterior positioning; on the contrary, alternative embodiments may include interior elements that serve functions similar to those of the cover 116.

The cover 116 also has an enclosure 128 disposed around the outlet aperture 126. The enclosure 128 has a hole 130 through which the deflection screw 120 extends. Furthermore, the cover 116 has a lip 132 with a diameter larger than that of the outer wall 124. The lip 132 overlaps a portion of the body 102 to secure the cover 116, and thence the entire head 100, to the body 102.

As shown, the deflection screw 120 has a head 134 and a shaft 136 extending from the head 134. The head 134 may be constructed substantially of a plastic material, and the shaft 136 may be formed of a corrosion resistant metal such as stainless steel, aluminum, copper, or brass. The head 134 has a slot 138 that facilitates rotation of the head 134 through the use of a tool such as a screwdriver. Additionally, the head 134 has a plurality of ridges 140 that protrude outward to facilitate gripping and rotation of the head 134 by hand. The shaft 136 has threads 142 disposed along its length to mate with corresponding threads within the hole 130 of the enclosure 128. Accordingly, rotation of the head 134 causes the shaft 136 to advance into or retract from the enclosure 128.

The flow control member 118 has an outer wall 146, only a small portion of which is visible through the outlet aperture 126 when the sprinkler 35 is fully assembled. In this application, the term "flow control member" does not require a tubular shape, but rather, includes any shape capable of conducting water through one or more flow paths.

A plurality of flow control features are formed in the outer wall 146. A "flow control feature" is any feature that extends into a water flow to affect a pattern with which the flow is sprayed. A flow control feature may be a nozzle with an enclosed shape that encircles and constricts the water flow. Alternatively, a flow control feature may simply be a deflector that protrudes into the flow without significantly affecting the flow rate of water past the deflector. The flow control features of the outer wall 146 are disposed within the cover 116. Accordingly, the flow control features of the outer wall 146 are disposed within the envelope or chamber (not shown) generally defined by the interior of the cover 116.

In the embodiment of FIG. 2, the flow control features of the outer wall 146 are nozzles; only a first nozzle 148 of the nozzles is visible through the outlet aperture 126. In the configuration of FIG. 2, the first nozzle 148 is aligned with the outlet aperture 126 so that water is sprayed from the head 100 through the first nozzle 148 and the outlet aperture 126.

The flow control member 118 has a dial 150 that extends through the cover 116, and is thus accessible to a user. The dial 150 has ridges 152 that facilitate gripping and rotation of the flow control member 118 by hand. The dial 150 may thus be used to control which of the nozzles formed in the outer wall 146 is aligned with the outlet aperture 126. In this application, a "dial" need not necessarily be a disk, but includes any disk-like, annular, or cylindrical shape that protrudes in some manner from a rotatable structure (such as the flow control member 118) so that a person may grip the dial and rotate it by hand to rotate the rotatable structure. The term "dial" also includes members that do not have a circular cross section, such as polygonal shapes or shapes with protruding extensions that facilitate gripping for rotation.

The body 102 also has an outer wall 156, an enlarged portion of which is coupled to the head 100 via an interference fit with the lip 132 of the cover 116. The enlarged portion may be connected to the remainder of the outer wall 156 by a plurality of gussets 158 arranged around the body 102.

The first arc adjustment ring 104 has a first lever 160 that protrudes generally radially away from the remainder of the first arc adjustment ring 104. The first lever 160 facilitates manual adjustment (i.e., adjustment by hand, without tools) of the orientation of the first arc adjustment ring 104 because a user may easily exert torque on the first arc adjustment ring 104 by pressing against the first lever 160 with the thumb or finger of a hand. The first arc adjustment ring 104 also has a plurality of ridges 162 that facilitate gripping and rotation of the first arc adjustment ring 104 by hand, apart from the first lever 160. The second arc adjustment ring 106 similarly has a second lever 164 that protrudes generally radially away from the remainder of the second arc adjustment ring 106, and ridges 162 that further facilitate manual rotation of the second arc adjustment ring 106.

The inlet plate 108 also has a plurality of ridges 168, which may facilitate gripping of the inlet plate 108 by hand. Thus, a user can grip the inlet plate 108 with one hand and either of the first and second adjustment rings 104, 106 to rotate them with respect to the inlet plate 108, thereby adjusting the angle through which the head 100 rotates.

As mentioned previously, the inlet shaft 110 extends through the inlet plate 108 to convey water to the body 102. The inlet shaft 110 has an o-ring 170 that abuts an adjoining portion of the inlet plate 108 to keep water from entering the sprinkler 35 through the annular space between the inlet shaft 110 and the inlet plate 108. The o-ring 170 may thus be formed of an elastomer such as rubber. The inlet shaft 110 also has a gasket 172 adjacent to the o-ring 170. The gasket 172 may be formed of a material that provides easy slippage, such as TEFLON. Thus, the gasket 172 may facilitate rotation of the inlet shaft 110 with respect to the inlet plate 108, without compromising the seal provided by the o-ring 170. The inlet shaft 110 threadably engages the body 102 within the sprinkler 35, and may thus have a slot 174 that facilitates rotation of the shaft 110 into threaded engagement with the body 102 during assembly of the sprinkler 35.

As mentioned above, the shaft 136 of the deflection screw 120 may be made of metal, while the o-ring 170 may be formed of an elastomer and the gasket 172 may be formed of a material such as TEFLON. However, the remaining components of the sprinkler 35 may generally be formed of plastic. The remaining components of the sprinkler 35, and the manner in which they cooperate to provide the operation described above, will be shown and described in connection with FIGS. 3–5.

Figure 3:
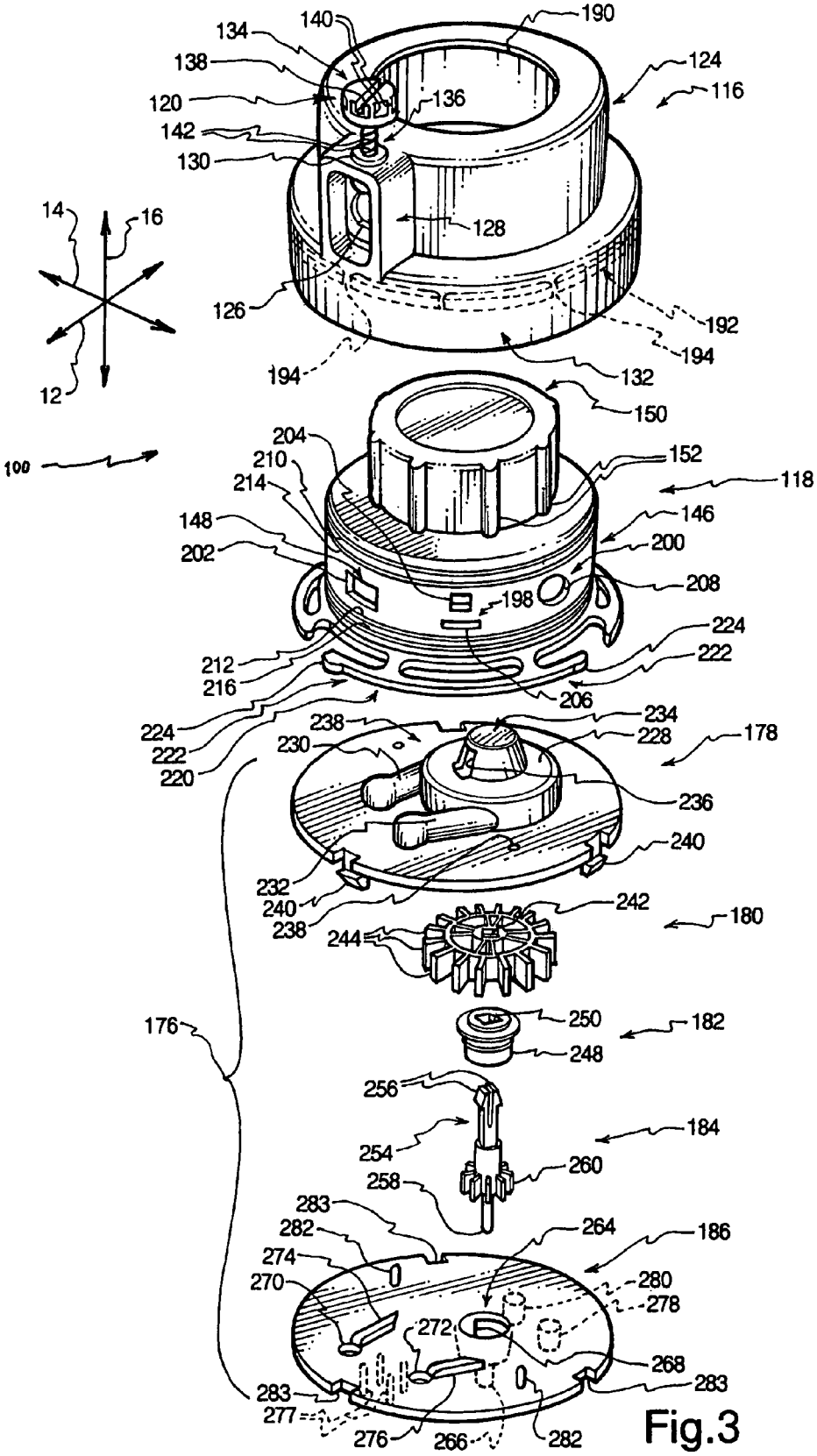
FIG. 3 is an exploded, perspective view of a head and a first portion of the drive mechanism of the sprinkler shown in FIG. 2.

Referring to FIG. 3, an exploded, perspective view illustrates a portion of the sprinkler 35 (shown in FIG. 2), including the head 100 and a first portion 176 of a drive mechanism of the sprinkler 35. The drive mechanism drives the rotation of the head 100 and body 102 (shown in FIG. 2) and is powered by motion of water through the sprinkler 35. As shown, the first portion 176 includes a first rotor enclosure plate 178, a rotor 180, a bushing 182, a spindle 184, and a second rotor enclosure plate 186.

The cover 116 has an opening 190 through which the dial 150 of the flow control member 118 extends when the sprinkler 35 is assembled. Additionally, the lip 132 of the cover 116 has an annular ring 192 that extends inward. The annular ring 192 has a plurality of notches 194 distributed about its circumference.

As mentioned previously, the flow control member 118 has a plurality of nozzles formed in the outer wall 146 of the flow control member 118. One of the nozzles is the first nozzle 148 partially visible in FIG. 2. The nozzles also include a second nozzle 198 and a third nozzle 200. Additionally, third, fourth, fifth, sixth, seventh, and eighth nozzles (not shown) may be provided and distributed evenly about the outer wall 146 with the first, second, and third nozzles 148, 198, 200. In alternative embodiments, more or less than eight nozzles may be provided.

The first, second, and third nozzles 148, 198, 200 comprise a plurality of orifices through which water flows. More precisely, the first nozzle 148 includes a first orifice 202 having a generally rectangular, horizontally disposed shape. The second nozzle 198 includes a second orifice 204 with a small square shape and a third orifice 206 with a generally rectangular, horizontally disposed shape. The third nozzle 200 includes a fourth orifice 208 with a generally circular shape. The orifices 202, 204, 206, 208 are merely exemplary; those of skill in the art will recognize that the orifices formed in the outer wall 146 may have a variety of shapes and three-dimensional contouring schemes. In this application, a "nozzle" may include multiple orifices.

The shapes of the orifices 202, 204, 206, 208 determine the pattern along which water is sprayed from the nozzles 148, 198, 200. For example, a rectangular orifice like the first and third orifices 202, 206 may provide a broadly angled, fan-shaped spray pattern, while smaller orifices like the second orifice 204 may provide a jet with a comparatively longer range. Accordingly, a wide variety of spray patterns and spray pattern combinations may be provided by the first, second, and third nozzles 148, 198, 200 and the fourth, fifth, sixth, seventh, and eighth nozzles of the flow control member. The spray patterns may include a variety of ranges, water distribution densities, and the like.

The outer wall 146 also has a first annular notch 210 and a second annular notch 212, which are disposed on either side of the portion of the outer wall 146 in which the first, second, and third nozzles 148, 198, 200 and the fourth, fifth, sixth, seventh, and eighth nozzles are located. A first o-ring 214 is seated in the first annular notch 210 and a second o-ring 216 is seated in the second annular notch 212. The first and second o-rings 214, 216 abut the interior of the outer wall 124 of the cover 116 to substantially keep water from leaving the annular space between the outer wall 146 of the flow control member 118 and the outer wall 124 of the cover 116, except through the outlet aperture 126. If desired, grease or some other lubricant may be applied to the o-rings 214, 216 to reduce the probability that the o-rings 214, 216 will bind against the outer wall 124 of the cover 116 during hot weather.

The flow control member 118 also has a detent flange 220 that extends outward from the outer wall 146. The detent flange 220 includes a plurality of arms 222, only two of which are visible in FIG. 3, that extend along a generally circular pathway coaxial with the outer wall 146. Each of the arms 222 terminates in a curved tab 224, each of which has an outward-facing curvature.

The detent flange 220 mates with the annular ring 192 of the lip 132 of the cover 116 in a manner that urges the flow control member 118 to remain in the positions in which one of the first, second, and third nozzles 148, 198, 200 and the fourth, fifth, sixth, seventh, and eighth nozzles is aligned with the outlet aperture 126. More precisely, the curved tabs 224 seat in the notches 194 of the annular ring 192 in such a manner that deflection of the arms 222 is required to permit rotation of the detent flange 220 within the annular ring 192. Accordingly, extra force is required to rotate the flow control member 118 such that a nozzle is moved out of alignment with the outlet aperture 126. Thus, the engagement of the detent flange 220 with the annular ring 192 helps a user to properly align each of the first, second, and third nozzles 148, 198, 200 and the fourth, fifth, sixth, seventh, and eighth nozzles with the outlet aperture 126.

As shown, the first and second rotor enclosure plates 178, 186 cooperate to define a space within which the rotor 180 is rotatably disposed. More specifically, the first rotor enclosure plate 178 has a rotor enclosure 228 that defines a generally cylindrical space. The rotor enclosure 228 is coupled to a first conduit 230 and a second conduit 232, each of which is also formed in the first rotor enclosure plate 178. The first and second conduits 230, 232 convey water to the rotor enclosure 228. The rotor enclosure 228 has an outlet cap 234 in which an outlet opening 236 is formed to release water from the rotor enclosure 228.

The first rotor enclosure plate 178 also has a plurality of orientation holes 238 that facilitate proper alignment of the first and second rotor enclosure plates 178, 186. Additionally, the first rotor enclosure plate 178 has three tabs 240 that are integrally formed with the remainder of the first rotor enclosure plate 178 to attach the first rotor enclosure plate 178, the second rotor enclosure plate 186, and the body 102 together.

The rotor 180 has a central hole 242 with a generally square profile. Additionally, the rotor 180 has a plurality of vanes 244 distributed about its perimeter so that water impinging against the vanes 244 is able to rotate the rotor 180. The bushing 182 has an outer wall 248 sized to seat in the second rotor enclosure plate 186 and a bore 250 into which the spindle 184 is insertable.

The spindle 184 has a shaft 254 with a pair of prongs 256 with wedge-shaped ends. The prongs 256 may be deflected, inserted through the central hole 242 of the rotor 180, and then allowed to snap back into an undeflected state to keep the rotor 180 and the spindle 184 together. The spindle 184 also has a post 258 with a relatively small diameter, and a gear 260 disposed between the post 258 and the shaft 254.

The second rotor enclosure plate 186 has a socket 264 in which a post receiver 266 is formed. The post receiver 266 has a generally tubular shape sized to permit insertion of the post 258 into the post receiver 266. The socket 264 also has an opening 268 through which the gear 260 is accessible from underneath the second rotor enclosure plate 186.

The second rotor enclosure plate 186 also has a first opening 270 and a second opening 272. The first and second openings 270, 272 are aligned to convey water to the first and second conduits 230, 232, respectively, of the first rotor enclosure plate 178. The second rotor enclosure plate 186 also has first and second plateaus 274, 276 disposed adjacent to the first and second openings 270, 272, respectively. The first and second plateaus 274, 276 cooperate with the first and second conduits 230, 232, respectively, to help restrict water leakage from the first and second conduits 230, 232.

The second rotor enclosure plate 186 also has two pair of receiving prongs 277 that facilitate valving of water flow into the first and second openings 270, 272. Furthermore, the second rotor enclosure plate 186 has first and second shaft receivers 278, 280 that facilitate retention of a reduction gear drive, which will be shown and described subsequently.

The second rotor enclosure plate 186 additionally has a pair of orientation posts 282 that extend toward the first rotor enclosure plate 178. The orientation posts 282 are insertable into the orientation holes 238 of the first rotor enclosure plate 178 to ensure that the first and second rotor enclosure plates 178, 186 are assembled together with the proper relative orientation. Additionally, notches 283 are formed in the periphery of the second rotor enclosure plate 186 to permit passage of the tabs 240 through the second rotor enclosure plate 186.

Figure 4:
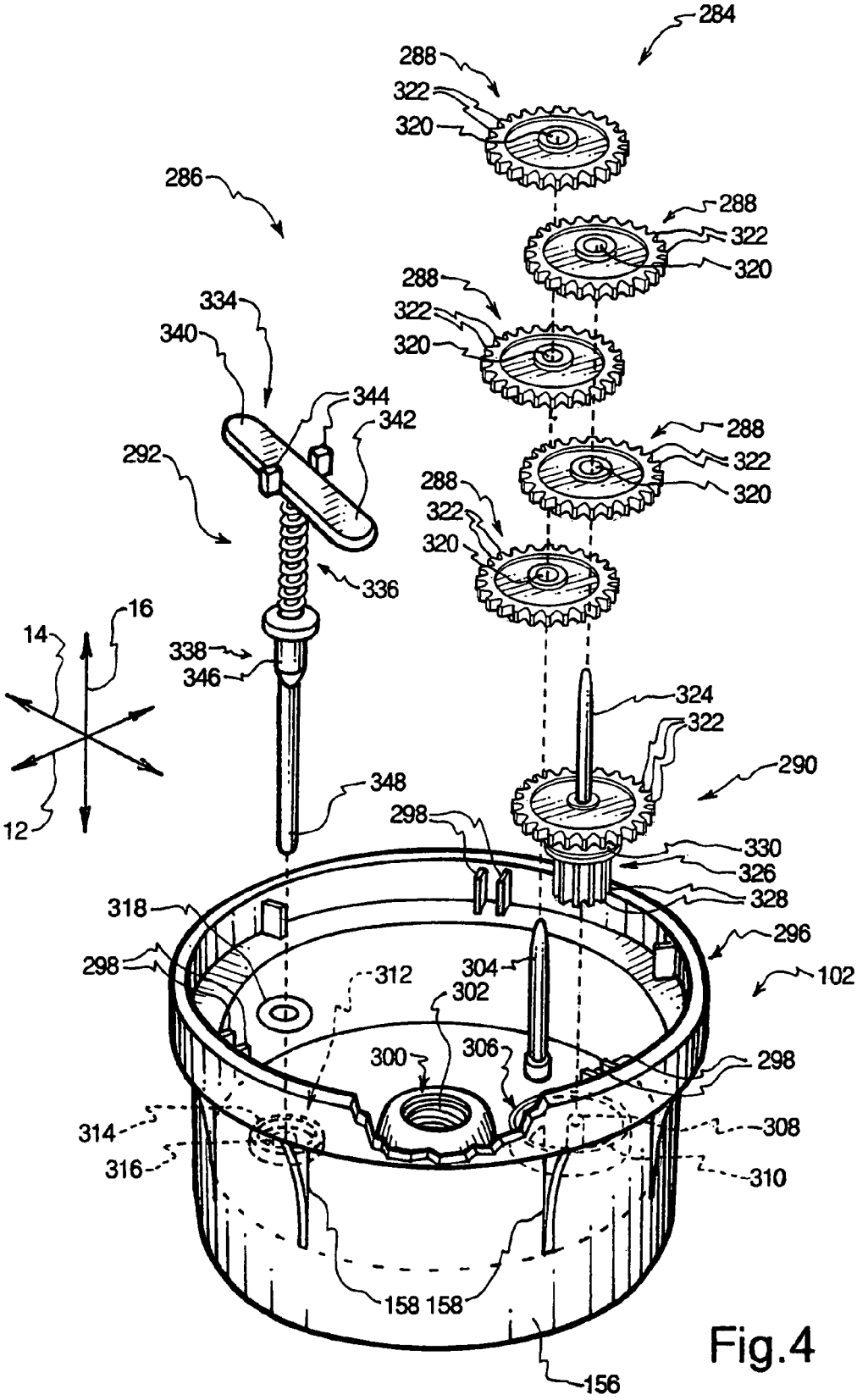
FIG. 4 is an exploded, perspective view of a body and a second portion of the drive mechanism of the sprinkler of FIG. 2.

Referring to FIG. 4, an exploded, perspective view illustrates the body 102 of the sprinkler 35 (shown in FIG. 2), together with a second portion 284 of the drive mechanism. As shown, the second portion 284 includes a reduction gear train 286 that provides a positive mechanical advantage. Accordingly, the reduction gear train 286 receives torque with a low magnitude and a high rotational rate, and provides a higher magnitude of torque at a lower rotational rate. The reduction gear train 286 includes a plurality of gears 288 and an output gear unit 290. The second portion 284 of the drive mechanism also has a valve 292 that determines which of the first and second openings 270, 272 of the second rotor enclosure plate 186 receives water.

As shown, the body 102 has a lip 296 that extends toward the head 100 of the sprinkler 35. The lip 296 is sized to provide a press fit with respect to the cover 116 of the head 100. The body 102 also has a plurality of tab receivers 298 that receive the tabs 240 of the first rotor enclosure plate 178 (shown in FIG. 3). The tabs 240 interlock with the tab receivers 298 in such a manner that the edges of the first and second rotor enclosure plates 178, 186 can be retained generally within the lip 296 of the body 102.

The body 102 also has a central hole 300 with threads 302 designed to mate with corresponding threads of an end of the inlet shaft 110 (shown in FIG. 2). The body 102 also has a shaft 304 that extends within the outer wall 156 of the body 102 to receive three of the gears 288 of the reduction gear train 286. Additionally, the body 102 has a socket 306 disposed generally adjacent to the shaft 304 to receive the output gear unit 290. The socket 306 has a post 308 that rotatably receives the output gear unit 290 and an opening 310 through which the output gear unit 290 is accessible from underneath the body 102.

The body 102 also has a valve retainer 312 designed to retain the valve 292 in engagement with the body 102. The valve retainer 312 has a lip 314 that encircles an opening 316 formed in the body 102. An o-ring 318 is designed to seat in the valve retainer 312 in such a manner that the o-ring fits within the lip 314, adjacent to the opening 316.

As shown, each of the gears 288 has a central hole 320 and a plurality of teeth 322 distributed about the central hole 320. The output gear unit 290 has a shaft 324 that extends through the remaining two of the gears 288 that are not disposed on the shaft 304 of the body 102. The shaft 324 of the output gear unit 290 is received by the first shaft receiver 278 of the second rotor enclosure plate 186, and the shaft 304 of the body 102 is received by the second shaft receiver 280 of the second rotor enclosure plate 186. The shaft 304 is positioned such that the uppermost of the gears 288 engages and is driven by the gear 260 coupled to the rotor 180 (shown in FIG. 3). The spacing between the shafts 304, 324 is such that the gears 288 mesh to transmit torque from the gear 260 to the output gear unit 290.

Additionally, the output gear unit 290 has an output gear 326 that seats in the socket 306. The output gear 326 has a hole (not shown) into which the post 308 of the socket 306 is inserted. The output gear 326 has a plurality of teeth 328. Furthermore, the output gear unit 290 has an o-ring 330 that abuts the wall of the socket 306 to restrict water leakage out of the body 102.

As shown, the valve 292 includes a rocker 334, an over-center spring 336, and a post 338. The rocker 334 has a first cover plate 340, a second cover plate 342, and a pair of pivot tabs 344 extending generally perpendicular to the plane within which the first and second cover plates 340, 342 are disposed. Each of the pivot tabs 344 is disposed between an adjacent pair of the receiving prongs 277. The pivot tabs 344 abut the second rotor enclosure plate 186 in such a manner that the rocker 334 is able to pivot with respect to the second rotor enclosure plate 186.

The rocker 334 is coupled to the post 338 via the over-center spring 336. The post 338 has an anchor 346 with a generally hemispherical or parabolic shape, from which a shank 348 extends. The shank 348 extends through the opening 316 of the valve retainer 312. The anchor 346 seats against the o-ring 318 in such a manner that a substantially watertight seal is provided between the anchor 346 and the o-ring 318 to restrict water leakage from the body 102. The over-center spring 336 causes the post 338 and the rocker 334 to pivot sequentially, in opposite directions. The shape of the anchor 346 maintains a seal against the o-ring 318 regardless of which position the post 338 is disposed in.

Figure 5:
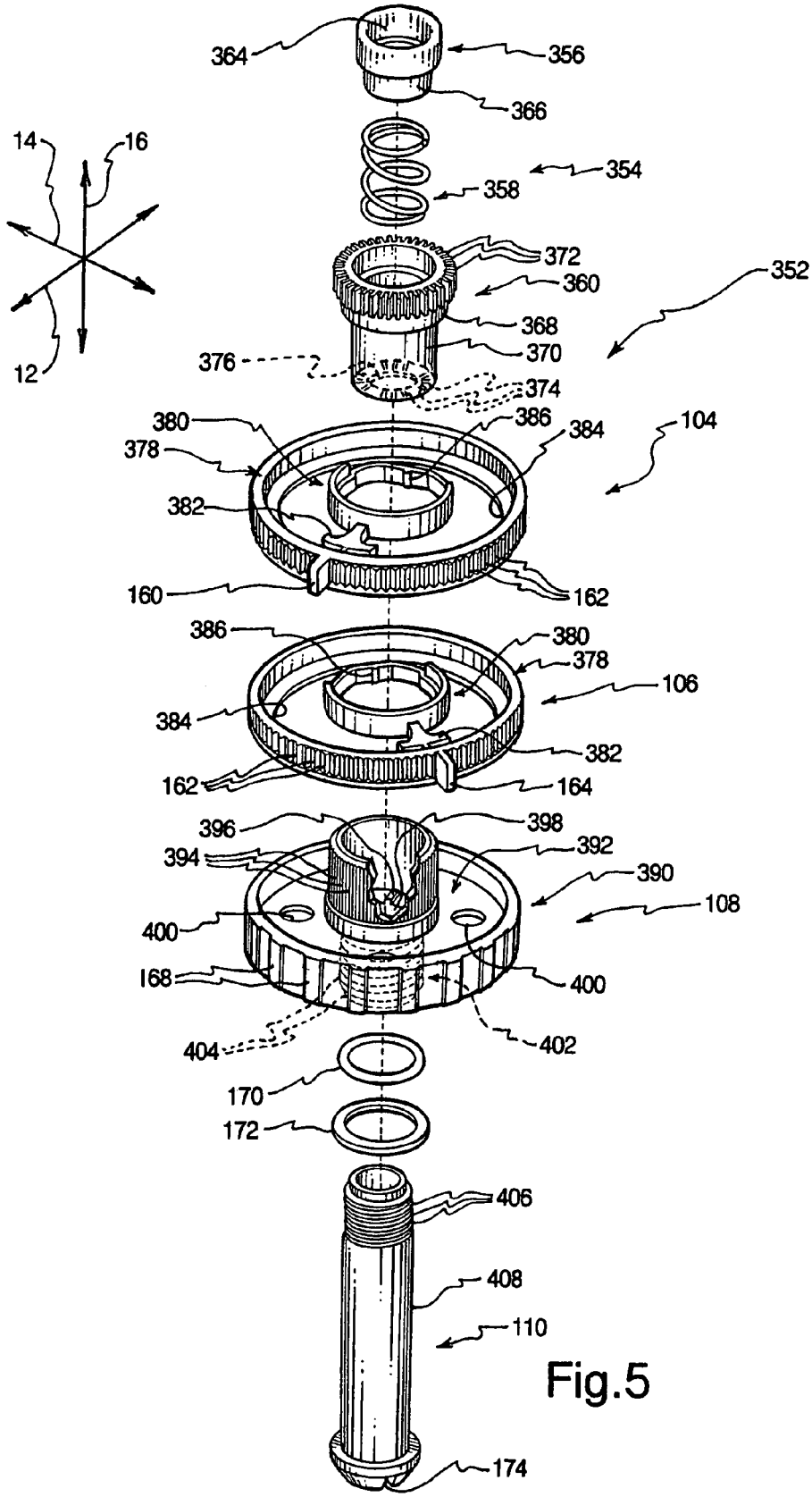
FIG. 5 is an exploded, perspective view of an inlet plate, an inlet shaft, and a third portion of the drive mechanism of the sprinkler of FIG. 2.

Referring to FIG. 5, an exploded, perspective view illustrates a third portion 352 of the drive mechanism, along with the arc adjustment rings 104, 106, the inlet plate 108, and the inlet shaft 110. The third portion 352 includes a clutch mechanism 354, which includes a collar 356, a spring 358, and a driving collar 360. As shown, the collar 356 has an enlarged portion 364 and a smaller portion 366. The collar 356 seats in the driving collar 360 in such a manner that the spring 358 is compressed within the driving collar 360 to press the collar 356 outward with respect to the driving collar 360. The driving collar 360 also has an enlarged portion 368 and a smaller portion 370. The enlarged portion 368 of the driving collar 360 has a plurality of teeth 372 that extend outward to engage the output gear 326 of the output gear unit 290 (shown in FIG. 4). Additionally, the driving collar 360 has a plurality of radial teeth 374 extending toward the inlet plate 108 and arranged around an opening 376.

The arc adjustment rings 104, 106 may be substantially identical, if desired. However, as shown, the second arc adjustment ring 106 may be inverted with respect to the first arc adjustment ring 104, such that the arc adjustment rings 104, 106 are disposed back-to-back. Each of the arc adjustment rings 104, 106 has an outer ring 378 on which the ridges 162 and the first or second lever 160 or 164 is disposed. Additionally, each of the arc adjustment rings 104, 106 has an inner ring 380 coaxial with the outer ring 378.

The inner and outer rings 380, 378 of each of the arc adjustment rings 104, 106 are coupled together by a bridge 382 extending generally radially. The inner ring 380, outer ring 378, and bridge 382 of each of the arc adjustment rings 104, 106 defines an arcuate slot 384 that extends nearly full-circle between the inner and outer rings 380, 378, and is interrupted only by the corresponding bridge 382. Each of the inner rings 380 has a ridge 386 that is oriented generally vertically and protrudes inward.

The inlet plate 108 has an outer wall 390 with a generally tubular configuration. The ridges 168 extend from the outer wall 390. The inlet plate 108 also has a socket 392 extending toward the body 102, within the inner rings 380 of the arc adjustment rings 104, 106. A plurality of exterior ridges 394 extend outward from the socket 392 in such a manner that the ridges 386 of the arc adjustment rings 104, 106 engage the exterior ridges 394.

Radial teeth 396 are disposed within the socket 392. The radial teeth 396 extend toward the driving collar 360 and are arranged about an opening 398 of the socket 392. The radial teeth 396 engage the radial teeth 374 of the driving collar 360 to restrict relative rotation between the inlet plate 108 and the driving collar 360. The clutch mechanism 354 permits the radial teeth 396 to disengage from the radial teeth 374 when excessive torque is applied between the inlet plate 108 and the body 102 and/or the head 100.

More precisely, the spring 358 presses the collar 356 against the body 102, thereby also pressing the radial teeth 396 into engagement with the radial teeth 374. The radial teeth 396 and/or the radial teeth 374 may be beveled in such a manner that, in the presence of strong relative torque (i.e., torque in excess of that experienced during normal operation of the sprinkler 35), the radial teeth 396 are able to disengage from the radial teeth 374, thereby permitting rotational slippage of the body 100 and the head 102. Accordingly, excessive applied torque generally will not damage the sprinkler 35.

The inlet plate 108 has a plurality of holes 400 that permit water to leave the space between the inlet plate 108 and the body 102. Accordingly, if water leaks, for example, through the socket 306 or the valve retainer 312 of the body 102, the water is able to exit the sprinkler 35 via the holes 400. Additionally, the inlet plate 108 has an inlet coupling 402 that protrudes from the remainder of the inlet plate 108. The inlet coupling 402 has male threads 404 designed to mate with corresponding female threads (not shown) of the base 33 or the base 34. The term "inlet coupling" broadly refers to any interface capable of connection to a water source. Accordingly, in alternative embodiments, an inlet coupling may be an opening, a quick-connect feature, or the like.

As shown, the inlet shaft 110 has threads 406 on an end thereof. The threads 406 are designed to mate with the threads 302 of the central hole 300 (shown in FIG. 4). Additionally, the inlet shaft 110 has a shank 408 that extends between the threads 406 and the gasket 172. The shank 408 is sized to pass through the openings 376, 398 of the driving collar 360 and the socket 392 of the inlet plate 108 with clearance so that the shank 408 is able to rotate freely with respect to the driving collar 360 and the socket 392.

Referring now to FIGS. 3, 4, and 5, the sprinkler 35 may be manufactured and assembled in a number of different ways. According to one method of manufacture, nearly all of the parts described above may be fabricated of plastics or similar materials via injection molding. The shaft 136 of the deflection screw 120 maybe formed of a corrosion resistant material such as stainless steel, aluminum, brass, or copper. The o-rings 170, 214, 216, 318, 330 may be made of elastomeric materials via molding or other known methods. In alternative embodiments of the invention, a number of components of the sprinkler 35 may be formed of ceramics, corrosion resistant metals, composite materials, or other known materials.

According to one method of assembly, the valve 292 and the reduction gear train 286 may first be assembled within the body 102. The shank 348 of the post 338 is inserted through the opening 316 of the valve retainer 312, and the post 338 and the rocker 334 are attached to the over-center spring 336 to form the valve 292. The output gear unit 290 is seated in the socket 306 of the body 102, and the gears 288 are disposed on the shaft 304 of the body 102 and the shaft 324 of the output gear unit 290.

The second rotor enclosure plate 186 is then seated within the lip 296 of the body 102 such that the notches 283 of the second rotor enclosure plate 186 are aligned with the tab receivers 298 of the lip 296. The shafts 304, 324 are then received by the first and second shaft receivers 278, 280, and the pivot tabs 344 of the rocker 334 seat between the adjacent pairs of receiving prongs 277 of the second rotor enclosure plate 186.

Then, the rotor 180, bushing 182, and spindle 184 are assembled, and the bushing 182 is seated in the socket 264 of the second rotor enclosure plate 186. The first rotor enclosure plate 178 is then installed by inserting the tabs 240 of the first rotor enclosure plate 178 through the notches 283 of the second rotor enclosure plate 186, and into engagement with the tab receivers 298 of the lip 296. The rotor 334 is then disposed within the rotor enclosure 228.

Then, the first and second arc adjustment rings 104, 106 are inserted into engagement with the inlet plate 108 such that the inner rings 380 of the arc adjustment rings 104, 106 encircle the socket 392 of the inlet plate 108. The inlet shaft 110 is inserted through the inlet coupling 402 and through the openings 376, 398 of the driving collar 360 and the socket 392 of the inlet plate 108. The inlet shaft 110 is rotated such that the threads 406 of the inlet shaft 110 threadably engage the threads 302 of the central hole 300. This draws the first adjustment ring 104 against the body 102.

The flow control member 118 is then inserted into the cover 116 so that the dial 150 is inserted through the opening 190 of the cover 116 and the curved tabs 224 of the detent flange 220 of the flow control member 118 are disposed within the notches 194 of the annular ring 192. The deflection screw 120 is rotated into threaded engagement with the hole 130 of the enclosure 128 of the cover 116. The cover 116 is then pressed into engagement with the lip 296 of the body 102.

Attachment of the cover 116 to the body 102 forms a plenum chamber (not shown) between the flow control member 118 and the first rotor enclosure plate 178. The plenum chamber is in fluid communication with all of the nozzles of the flow control member 118. Accordingly, all of the nozzles of the flow control member 118 are simultaneously exposed to the water flowing through the sprinkler 35, but water only flows through the nozzle that is aligned with the outlet aperture 126.

The sprinkler 35 is then fully assembled, and may simply be attached to the corresponding base 33 or 34. The base 33 or 34 may be coupled to the corresponding hose 37, 39, or 41. The foregoing steps may generally be performed by hand. If desired, a screwdriver or other tool may be inserted into the slot 174 to rotate the inlet shaft 110.

The arc adjustment rings 104, 106 are rotated so that the first and second levers 160, 164 are disposed at the desired limits of the angle of rotation of the sprinkler 35. Although only one of the arc adjustment rings 104 or 106 need be rotated to establish the magnitude of the angle of rotation, it may be beneficial to orient both of the arc adjustment rings 104, 106 to position the ends of the angle of rotation, thereby avoiding the need to rotate the entire sprinkler head 35. The dial 150 is rotated until the desired nozzle of the flow control member 118 is aligned with the outlet aperture 126. Additionally, the deflection screw 120 is rotated to dispose the shaft 136 at the desired position with respect to the outlet aperture 126.

Water enters the inlet shaft 110 from the base 33 or 34, and is conveyed to the body 102. The water flows through the reduction gear train 286, and through the one of the first and second openings 270, 272 of the second rotor enclosure plate 186, depending on which of the first and second openings 270, 272 is left open by the valve 292. The water flows into the rotor enclosure 228 and rotates the rotor 180 in the direction that corresponds to the opening 270, 272 through which the water flows. The water then flows into the plenum chamber, and out of the head 100 through the selected nozzle. The water is sprayed with a pattern determined by the selected nozzle and the position of the shaft 136 of the deflection screw 120.

The rotor 180 rotates and the torque from the rotor 180 is transmitted through the spindle 184 to reach the reduction gear train 286. The torque is transmitted through the gears 288 and to the output gear unit 290. The output gear unit 290 rotates against the teeth 372 of the driving collar 360, thereby inducing the body 102, the head 100, and the inlet shaft 110 to rotate with respect to the arc adjustment rings 104, 106 and the inlet plate 108. As mentioned previously, the reduction gear train 286 decreases the rate of rotation and increases the torque provided by the rotor 180.

When the body 102 rotates far enough along one direction to cause the shank 348 of the post 338 to contact the bridge 382 of one of the arc adjustment rings 104, 106, the shank 348 is pressed sideways to induce pivotal motion of the post 338. Pivotal motion of the post 338 is transmitted through the over-center spring 336 to the rocker 334. The rocker 334 pivots to close one of the openings 270, 272, and open the other of the openings 270, 272 to water flow. The over-center spring 336 causes the valve 292 to remain in each position until it is moved into the opposite position due to contact with one of the bridges 382. The over-center spring 336 also prevents the valve 292 from remaining between the two desired positions.

In alternative embodiments of the invention, a flow control member with multiple nozzles may be disposed outside a single outlet aperture, and may be movable with respect to the outlet aperture to control which nozzle receives water flow. Furthermore, the nozzles may be angled at an upward orientation. One example of such an embodiment will be shown and described in connection with FIGS. 6 and 7, as follows.

Figure 6:
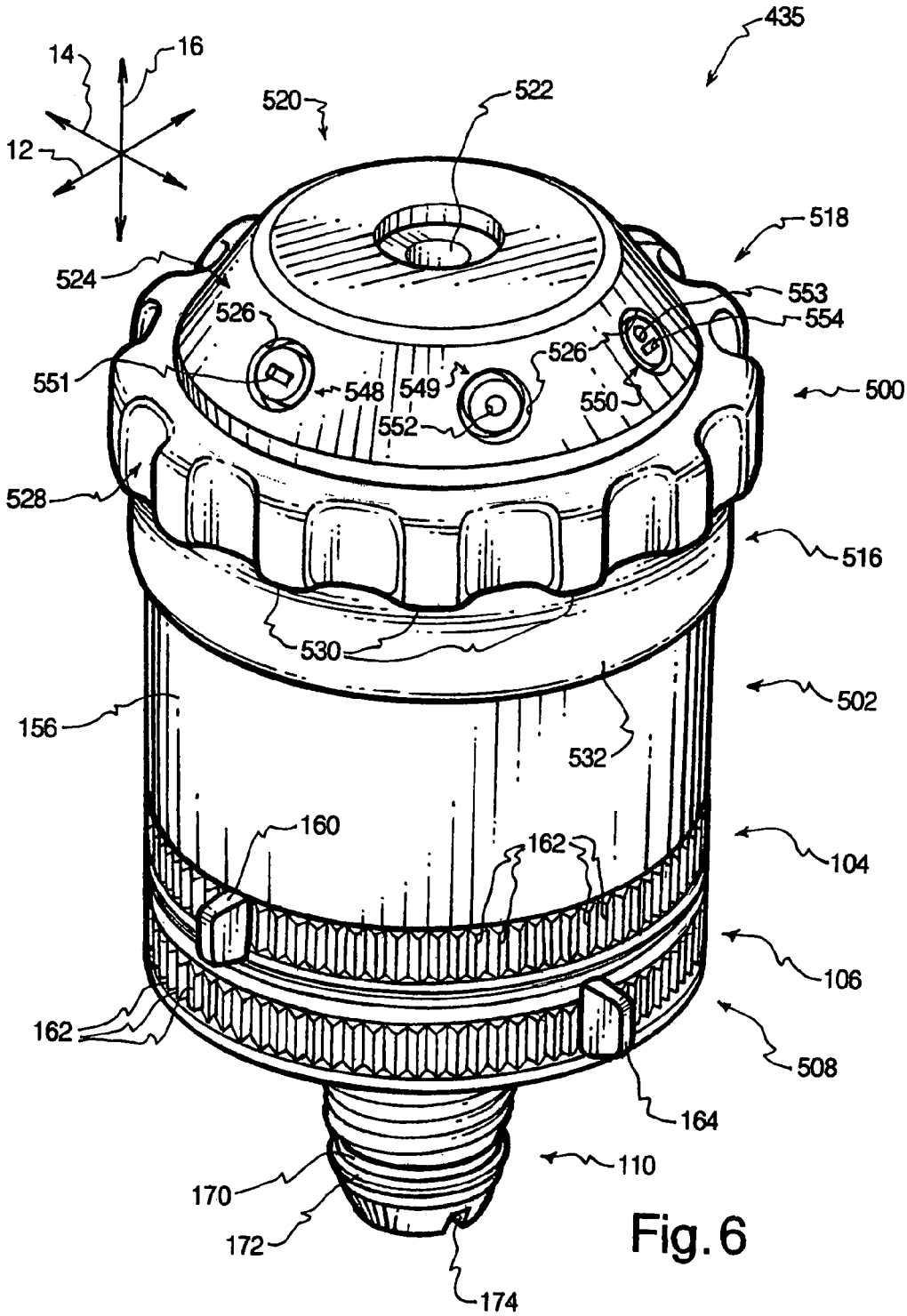
FIG. 6 is a perspective view of a sprinkler according to one alternative embodiment of the invention.

Referring to FIG. 6, a perspective view illustrates a sprinkler 435 according to one embodiment of the invention. As shown, the sprinkler 435 has first and second arc adjustment rings 104, 106 and an inlet shaft 110 similar to those of the previous embodiment. Additionally, the sprinkler 435 has a head 500, a body 502, and an inlet plate 508 that are configured somewhat differently from those of the previous embodiment. The body 502 is similar to the body 102 of the previous embodiment, except that the body 502 lacks the gussets 158 of the body 102. The inlet plate 508 is somewhat thinner than the inlet plate 108 and lacks the ridges 168. However, the head 500 is different from the head 100 in more substantial ways.

As shown, the head 500 has a cover 516, a flow control member 518, and a cap 520. The flow control member 518 and the cap 520 are attached to the cover 516 by an attachment screw 522. The cap 520 has an outer wall 524 that is generally frustoconical in shape. A plurality of holes 526 is formed in the outer wall 524. The flow control member 518 has a dial 528 with a plurality of ridges 530 facilitate rotation of the flow control member 518 by hand. The cover 516 has a lip 532 that is press fitted to the body 502.

By contrast with the head 100 of the previous embodiment, the cover 516 is disposed inward of, or upstream of, the flow control member 518 in the head 500 of FIG. 6. The cover 516 has an outlet aperture (not shown). The flow control member 518 has a first nozzle 548, a second nozzle 549, and a third nozzle 550 that are exposed via the holes 526 of the outer wall 524 of the cap 520. The first nozzle 548 has a first orifice 551, the second nozzle 549 has a second orifice 552, and the third nozzle 550 has third and fourth orifices 553, 554. The orifices 551, 552, 553, 554 provide a variety of watering patterns. The flow control member 518 can be rotated via the dial 528 to dispose any of the nozzles 548, 549, 550 in fluid communication with the outlet aperture, thereby providing flow through the corresponding orifice(s) 551, 552, or 553 and 554.

Figure 7:
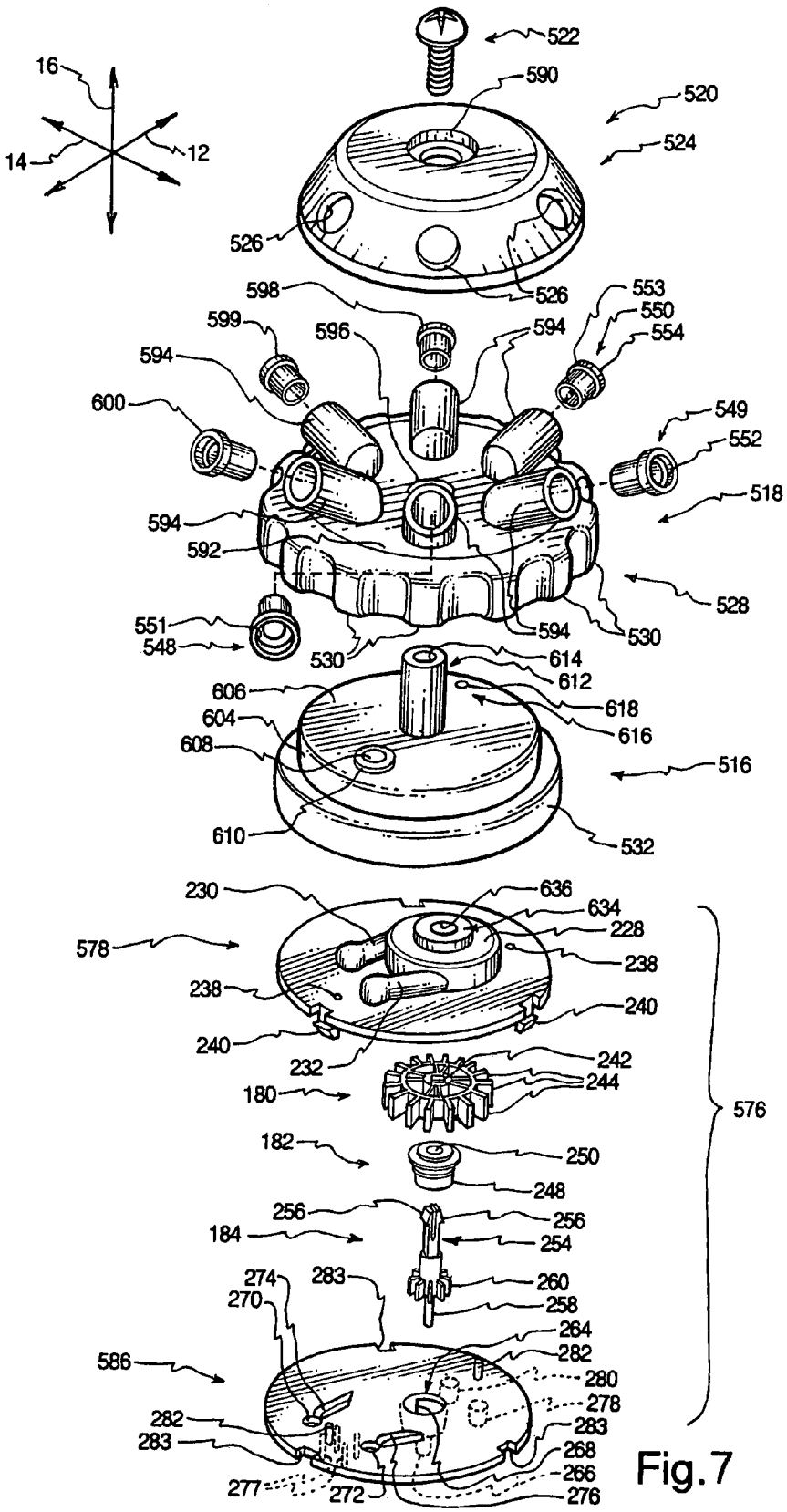
FIG. 7 is an exploded, perspective view of a head and a first portion of a drive mechanism of the sprinkler shown in FIG. 6.

Referring to FIG. 7, an exploded, perspective view illustrates the head 500 and a first portion 576 of a drive mechanism of the sprinkler 435. As shown, the first portion 576 includes a first rotor enclosure plate 578 and a second rotor enclosure plate 586, which are similar to their counterparts of the previous embodiment. However, some differences exist, which will be described subsequently.

As shown, the cap 520 has an opening 590 through which the attachment screw 522 extends. The cap 520 also has a counterbore within the opening 590. The head of the attachment screw 522 seats against the counterbore to hold the cap 520 in place. The flow control member 518 has a plate 592 with a generally disk-like shape. The flow control member 518 also has extension tubes 594 that extend from the plate 592. As shown, each of the extension tubes 594 may have a bent configuration such that the tubes 594 extend upward from the plate 592, and then outward at an angle closer to being parallel with the plate 592. The extension tubes 594 encircle and extend generally away from a central opening 596 formed in the plate 592.

As shown, in addition to the first, second, and third nozzles 548, 549, 550, the flow control member 518 has a fourth nozzle 598, a fifth nozzle 599, and a sixth nozzle 600. Although six nozzles are illustrated in FIG. 7, any number of nozzles maybe provided in alternative embodiments of the invention. The nozzles 548, 549, 550, 598, 599, 600 may be formed separately from the remainder of the flow control member 518, and may be installed, either permanently or removably, within the extension tubes 594.

According to some embodiments, the nozzles 548, 549, 550, 598, 599, 600 may have features designed to snap into engagement with the extension tubes 594 to permit relatively easy removal of the nozzles 548, 549, 550, 598, 599, 600 for repair or replacement. Alternatively, the nozzles 548, 549, 550, 598, 599, 600 may be fastened in place, or may be permanently positioned via bonding, ultrasonic welding, or the like. According to yet other alternatives, the nozzles 548, 549, 550, 598, 599, 600 may be integrally formed with the extension tubes 594.

The dial 528 is disposed about the periphery of the plate 592, and is rigidly attached thereto. If desired, the dial 528 may be integrally formed with the plate 592. Alternatively, the dial 528 may be formed separately from the plate 592 and attached to the plate 592 via ultrasonic welding or the like. The plate 592 may have a downward curving lip (not visible) about which the dial 528 is attached.

The cover 516 has a shoulder 604 sized to fit generally within the dial 528, against the plate 592. The shoulder 604 is sized somewhat smaller than the lip 532. The shoulder 604 is spanned by a plate 606 parallel to the plate 592. The plate 606 generally rests against the plate 592.

The plate 606 has an outlet aperture 608 positioned such that the inlets of the extension tubes 594 are alignable with the outlet aperture 608 to permit water flow through the outlet aperture 608 and into the extension tube 594 that is aligned with the outlet aperture 608. The rotational orientation of the flow control member 518 with respect to the cover 516 determines which of the extension tubes 594 receives water through the outlet aperture 608. The head 500 includes an o-ring 610 seated in an indentation (not visible) surrounding the outlet aperture 608 to restrict water leakage from the outlet aperture 608, between the plates 592, 606.

The cover 516 also has a shaft 612 that extends upward, through the central opening 596 of the plate 592 of the flow control member 518. The shaft 612 has a bore 614 that is threaded to receive the attachment screw 522. The interior shelf of the opening 590 of the cap 520 may be aligned flush with the end of the flow control member 518 when the head 500 is assembled so that installation of the attachment screw 522 tends to keep the cap 520 and the flow control member 518 in place, with respect to the cover 516.

Additionally, the cover 516 has a detent mechanism 616 positioned on the plate 606. The detent mechanism 616 may take the form of a ball-and-spring detent, with a ball 618 partially exposed by the plate 606 and a spring (not visible) disposed behind the ball 618 to urge the ball 618 toward the plate 592 of the flow control member 518. The plate 592 may have a plurality of indentations and/or ridges (not shown) aligned with the extension tubes 594 so that the ball 618 is able to slide toward the plate 592 when each of the extension tubes 594 is aligned with the outlet aperture 608. Hence, the detent mechanism 616 resists rotation of the flow control member 518 that moves any of the extension tubes 594 out of alignment with the outlet aperture 608.

The first and second rotor enclosure plates 578, 586 are similar to their counterparts in FIG. 3, with some relatively minor changes. More precisely, the first rotor enclosure plate has a rotor enclosure 228 like that of the first rotor enclosure plate 178 of the previous embodiment. However, the first rotor enclosure plate 578 of FIG. 7 has an outlet cap 634 with an outlet opening 636 oriented generally parallel to the plate 606 of the cover 516. Additionally, the orientation holes 238 of the first rotor enclosure plate 578 are positioned differently from those of the first rotor enclosure plate 178 of the previous embodiment. The orientation posts 282 of the second rotor enclosure plate 586 are disposed in alignment with the orientation holes 238 of the first rotor enclosure plate 578. The configuration and operation of the rotor plates 578, 586 are otherwise similar to those of the rotor plates 178, 186.

The sprinkler 435 may be manufactured and assembled according to methods similar to those used to manufacture and assemble the sprinkler 35 of the previous embodiment. More precisely, the various parts of the body 502, arc adjustment rings 104, 106, inlet plate 508, and inlet shaft 110, and the associated drive mechanism, may be manufactured and assembled generally in the manner described in connection with the previous embodiment. The head 500 may be manufactured and assembled as follows.

The cover 516, flow control member 518, and cap 520 of the head 500 may be formed of plastic materials by injection molding or the like, and the adjustment screw 522 may be formed via a known operation such as casting. After assembly of the body 502, arc adjustment rings 104, 106, inlet plate 508, inlet shaft 110, and drive mechanism, the various parts of the head 500 may be assembled and attached to the body 502.

More precisely, the lip 532 of the cover 516 may be press fitted to the body 502. If the detent mechanism 616 has not yet been assembled, the spring (not shown) is inserted into the corresponding recess of the plate 606 of the cover 516 and the ball 618 is disposed to extend from the plate 606. The flow control member 518 may then be inserted into engagement with the cover 516 such that the shaft 612 of the cover 516 passes through the central opening 596 of the plate 592 of the flow control member 518, and the dial 528 is disposed around the shoulder 604 of the cover 516.

The cap 520 is then disposed on the flow control member 518 such that the holes 526 of the outer wall 524 of the cap 520 align with the nozzles 548, 549, 550, 598, 599, 600. The nozzles 548, 549, 550, 598, 599, 600 extend at least partially into the holes 526 so that rotation of the flow control member 518 also induces rotation of the cap 520. The attachment screw 522 is rotated into threaded engagement with the bore 614 of the shaft 612 of the cover 516 to keep the cap 520, flow control member 518 and cover 516 together.

The sprinkler 435 may be used in a manner similar to that of the sprinkler 35 of the previous embodiment. More precisely, the arc through which the spray from the head 500 rotates may be established through the use of the first and second arc adjustment rings 104, 106, as described in connection with the previous embodiment. The active nozzle may be selected by rotating the dial 528, thereby rotating the flow control member 518 and the cap 520, until the desired one of the nozzles 548, 549, 550, 598, 599, 600 is aligned with the outlet aperture 608 of the cover 516. As with the previous embodiment, this may be carried out while the sprinkler 435 is operating, or prior to providing water flow to the sprinkler 435. When water flow is provided, the sprinkler 435 rotates in oscillatory fashion through the selected angle and sprays water with a spray pattern corresponding to the selected nozzle of the nozzles 548, 549, 550, 598, 599, 600.

Figure 8:
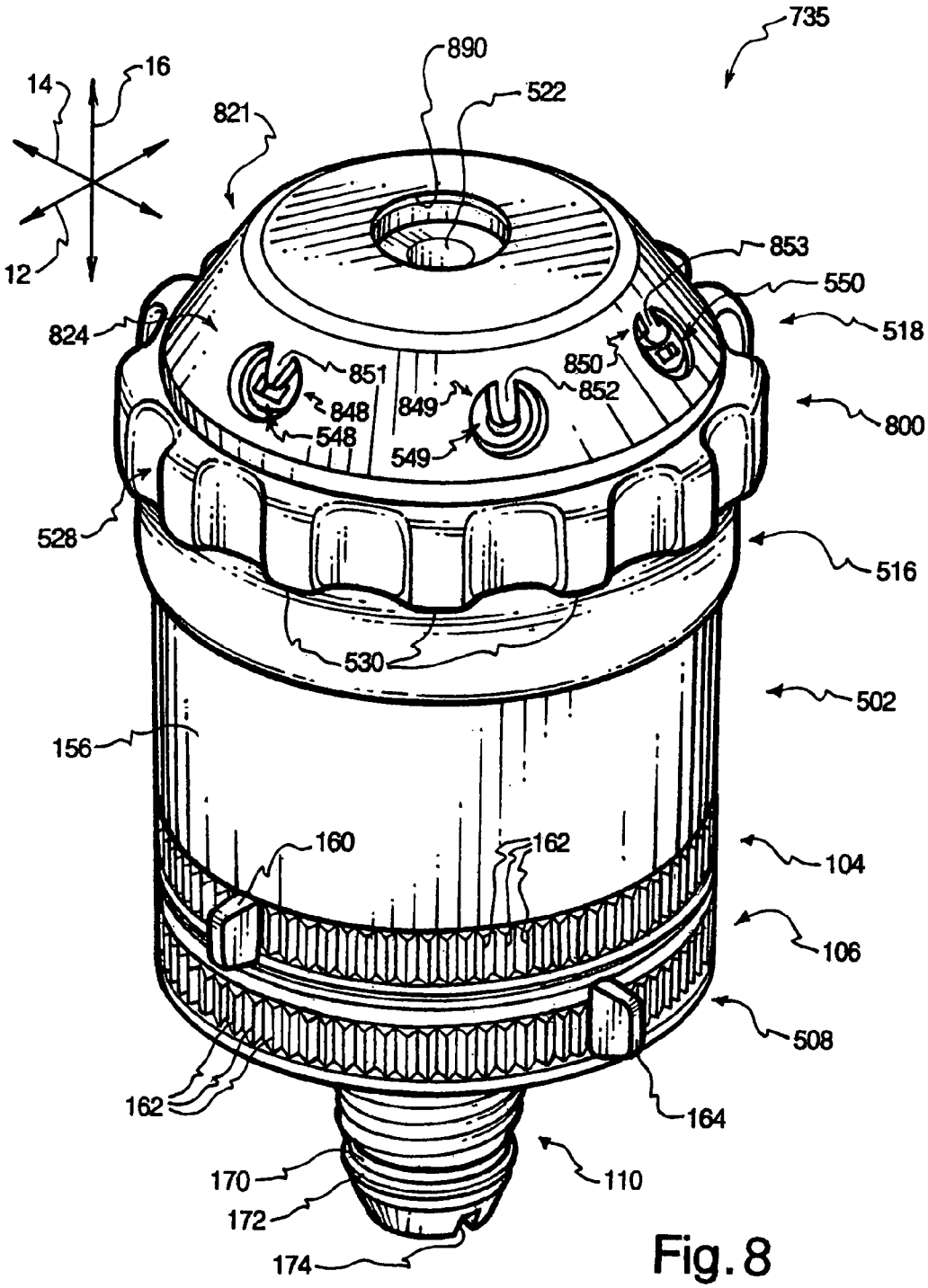
FIG. 8 is a perspective view of a sprinkler according to another alternative embodiment of the invention.

The sprinkler 435 of FIGS. 6 and 7 lacks any system by which variable deflection may be applied to the water stream exiting the head 500 via the selected nozzle. In alternative embodiments, variable deflection may be provided with a head configuration similar to that of FIGS. 6 and 7. FIG. 8 illustrates one example of such an embodiment.

Referring to FIG. 8, a perspective view illustrates a sprinkler 735 according to one alternative embodiment of the invention. As shown, the sprinkler 735 is similar to the sprinkler 435 of the previous embodiment. The sprinkler 735 has a body 502, first and second arc adjustment rings 104, 106, an inlet plate 508, and an inlet shaft 110 that are similar to those of the previous embodiment. Additionally, the sprinkler 735 has a head 800 with a configuration slightly different from that of the previous embodiment.

More precisely, the head 800 has a cover 516, a flow control member 518, a cap 520 (not visible), and an adjustment screw 522 like those of the previous embodiment. Additionally, the head 800 has a deflector flow control member 821 disposed to generally cover the cap 520. The deflector flow control member 821 has an outer wall 824 with a generally frustoconical shape corresponding to the frustoconical shape of the outer wall 524 of the cap 520. The outer wall 824 has a plurality of openings equal in number to the number of nozzles 548, 549, 550, 598, 599, 600. Accordingly, six openings may be formed in the outer wall 824. Of these, a first opening 848, a second opening 849, and a third opening 850 are visible in FIG. 8. In alternative embodiments, the number of openings in the outer wall 824 need not be equal to the number of nozzles 548, 549, 550, 598, 599, 600. Rather, more or fewer openings may be provided, from one to an unlimited number.

As shown, each of the first, second, and third openings 848, 849, 850 provides a different deflection of the stream sprayed by the selected nozzle of the nozzles 548, 549, 550, 598, 599, 600. More precisely, a first deflector 851 is formed in the first opening 848. The first deflector 851 extends to block a portion of the water flowing through the first opening 848. Similarly, a second deflector 852 is formed in the second opening 849 and a third deflector 853 is formed in the third opening 850. The first, second, and third deflectors 851, 852, 853 provide different shapes so that the water flow from the head 800 can be obstructed in a number of ways to provide a variety of spray pattern adjustment possibilities.

The deflector flow control member 821 also has an opening 890 similar to the opening 590 (not shown) formed in the cap 520. The opening 890 has a counterbore within which the head of the adjustment screw 522 seats. The counterbore of the opening 890 seats within the counterbore of the opening 590. The deflector flow control member 821 and the cap 520 are rotatable independently of each other, with respect to the cover 516. As in the previous embodiment, the flow control member 518 rotates with the cap 520.

As in the previous embodiment, the flow control member 518 may be urged to remain in orientations in which one of the nozzles 548, 549, 550, 598, 599, 600 is in fluid communication with the outlet aperture 608 via a detent mechanism like the detent mechanism 616 illustrated in FIG. 7. A second detent mechanism (not shown) similar to the detent mechanism 616 may be disposed between the cap 520 and the deflector flow control member 821 so that the deflector flow control member 821 is urged to remain in orientations in which one of the openings 848, 849, 850 or the remaining openings of the deflector flow control member 821 is aligned with the selected nozzle.

In alternative embodiments, the opening 890 may be omitted from the deflector flow control member 821, and the deflector flow control member 821 may instead cover the head of the attachment screw 522. The deflector flow control member 821 may then have inwardly extending tabs (not shown), an inwardly extending lip (not shown), or the like, that seats within an annular groove (not shown) formed in the cap 520 to rotatably attach the deflector flow control member 821 to the cap 520. Accordingly, the attachment screw 522 may be hidden to provide a smoother appearance.

The independent rotation of the deflector flow control member 821 and the cap 520 enables the sprinkler 735 to provide independent selection of the active nozzle and the deflector that deflects the water stream sprayed by the active nozzle. Accordingly, the sprinkler 735 provides a wide range of irrigation options, aside from selection of the angle through which irrigation occurs.

In alternative embodiments, the flow control features (i.e., nozzles and/or deflectors) of a sprinkler may be arranged in a wide variety of ways. The movable element(s) that carry the nozzles and/or deflectors need not rotate, but may instead be linearly translatable or otherwise movable. Alternatively, the nozzles and/or deflectors may be stationary, and the outlet aperture may be disposed on a movable element to permit alignment with the nozzles and/or deflectors. The nozzles and/or deflectors may be disposed upstream or downstream of the outlet aperture, and may be exposed or covered by covers, caps, or the like. In certain embodiments, a single movable element (not shown) may have a plurality of nozzles and deflectors aligned with the nozzles so that selection of a nozzle also constitutes selection of an accompanying deflector.

The sprinkler 735 may be manufactured and assembled in ways that are similar to those of the previous embodiment. The deflector flow control member 821 may be formed of a plastic via injection molding or the like. The deflector flow control member 821 may be inserted over the cap 520 after placement of the cap 520 over the flow control member 518, but before installation of the attachment screw 522. After the deflector flow control member 821 has been positioned, the attachment screw 522 may be inserted through the openings 890, 590 and rotated into threaded engagement with the bore 614 of the shaft 612 of the cover 516. The attachment screw 522 then holds the deflector flow control member 821, cap 520, flow control member 518, and cover 516 together.

Use of the sprinkler 735 is similar to that described in connection with the previous embodiment. The angle of rotation of the head 800 and the active nozzle are selected as described in connection with the previous embodiments. Additionally, the deflector flow control member 821 may be rotated to align one of the first, second, and third openings 848, 849, 850 or one of the remaining openings with the selected nozzle. This may be carried out regardless of whether the sprinkler 735 is currently operating. Water is then sprayed from the sprinkler 735 through the selected nozzle and deflected by the selected deflector as the head 800 rotates through the selected angle.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. An irrigation system for disturbing water to soil, the irrigation system comprising:

a sprinkler comprising:

an inlet coupling disposed to receive water from a source of pressurized water;

a head comprising a cover having an outlet aperture, the head further comprising a plurality of flow control features, each of which is movable into fluid communication with the outlet aperture to control distribution of water received through the inlet coupling to the soil through the outlet aperture, wherein the cover comprises a substantially flat plate in which the outlet aperture is formed, wherein the head further comprises a flow control member comprising a plurality of tubular extensions, each of which is disposed to convey water to one of the flow control features, wherein the flow control member is rotatable about the generally vertical axis to align any of the tubular extensions with the outlet aperture; and a drive mechanism coupled to the cover to induce reversing rotation of the outlet aperture about a generally vertical axis through an angle of rotation, the drive mechanism comprising a reduction gear train that conveys torque from the rotor to the cover with a positive mechanical advantage, wherein the reduction gear train is exposed to the water received through the inlet coupling.

2. The irrigation system of claim 1, wherein the flow control features are disposed within a chamber defined by the cover.

3. The irrigation system of claim 2, wherein the cover comprises a substantially tubular shape having an outer wall, wherein the outlet aperture is formed in the outer wall, wherein the head further comprises a flow control member comprising a substantially tubular shape comprising an outer wall in which the flow control features are formed, wherein the flow control member is rotatable about the generally vertical axis.

4. The irrigation system of claim 3, wherein the head further comprises a plenum chamber within the flow control member, wherein all of the flow control features are simultaneously in fluid communication with the inlet coupling via the plenum chamber.

5. The irrigation system of claim 1, wherein each of the flow control features comprises a nozzle, wherein the head further comprises a deflector flow control member disposed outside the flow control member, wherein the deflector flow control member comprises an outer wall in which a plurality of deflectors are formed, wherein the deflector flow control member is rotatable about the generally vertical axis to align any of the deflectors with any of the nozzles.

6. The irrigation system of claim 1, wherein the head further comprises a detent mechanism that urges the flow control features, collectively, to remain in any of a plurality of orientations, wherein in each of the orientations, one of the flow control features is in fluid communication with the outlet aperture.

7. The irrigation system of claim 1, wherein the plurality of flow control features comprises at least six flow control features comprising a plurality of differently-shaped orifices.

8. The irrigation system of claim 1, wherein the sprinkler further comprises a body that encases at least a portion of the drive mechanism, wherein the drive mechanism is coupled to first and second levers extending outward with respect to the body, wherein the first and second levers are coupled to first and second arcuate slots, wherein the first and second levers are relatively movable to control the angle of rotation, wherein the head further comprises a dial manually rotatable to move the flow control features into fluid communication with the outlet aperture.

9. The irrigation system of claim 1, wherein each of the flow control features comprises a nozzle through which the water flows in such a manner that water flow is constricted by the nozzle.

10. The irrigation system of claim 1, wherein each of the flow control features comprises a deflector extending into the water in such a manner that the deflector does not, by itself, substantially constrict water flow.

11. The irrigation system of claim 1, further comprising a base unit comprising a garden hose coupling and a sprinkler coupling, wherein the garden hose coupling is designed to be connected to receive water from a standard garden hose and the sprinkler coupling is in fluid communication with the garden hose coupling and is connectable to the inlet coupling of the sprinkler.

12. The irrigation system of claim 11, further comprising a valve disposed upstream of the base unit and a timer electrically coupled to the valve to control water flow to the sprinkler.

13. An irrigation system for disturbing water to soil, the irrigation system comprising:

a sprinkler comprising:

a body;

an inlet coupling disposed to conduct water into the body from a source of pressurized water;

a head comprising a cover having an outlet aperture, the head further comprising a plurality of flow control features, each of which is movable into fluid communication with the outlet aperture to control distribution of water received through the inlet coupling to the soil through the outlet aperture, the head comprising a dial axially displaced from the flow control features, wherein the dial is manually rotatable to move the flow control features into fluid communication with the outlet aperture; and a drive mechanism, at least a portion of which is encased by the body, wherein the drive mechanism is coupled to the body to induce reversing rotation of the outlet aperture about a generally vertical axis through an angle of rotation, wherein the drive mechanism is coupled to first and second levers extending outward with respect to the body, wherein the first and second levers are relatively movable to control the angle of rotation.

14. The irrigation system of claim 13, wherein the flow control features are disposed within a chamber defined by the cover.

15. The irrigation system of claim 14, wherein the cover comprises a substantially tubular shape having an outer wall, wherein the outlet aperture is formed in the outer wall, wherein the head further comprises a flow control member comprising a substantially tubular shape comprising an outer wall in which the flow control features are formed, wherein the flow control member is rotatable about the generally vertical axis.

16. The irrigation system of claim 15, wherein the head further comprises a plenum chamber within the flow control member, wherein all of the flow control features are simultaneously in fluid communication with the inlet coupling via the plenum chamber.

17. The irrigation system of claim 14, wherein the plurality of flow control features comprises at least six flow control features comprising a plurality of differently-shaped orifices.

18. The irrigation system of claim 13, wherein the cover comprises a substantially flat plate in which the outlet aperture is formed, wherein the head further comprises a flow control member comprising a plurality of tubular extensions, each of which is disposed to convey water to one of the flow control features, wherein the flow control member is rotatable about the generally vertical axis to align any of the tubular extensions with the outlet aperture, wherein the dial is fixedly attached to the flow control member.

19. The irrigation system of claim 18, wherein each of the flow control features comprises a nozzle, wherein the head further comprises a deflector flow control member disposed outside the flow control member, wherein the deflector flow control member comprises an outer wall in which a plurality of deflectors are formed, wherein the deflector flow control member is rotatable about the generally vertical axis to align any of the deflectors with any of the nozzles.

20. The irrigation system of claim 13, wherein each of the flow control features comprises a nozzle through which the water flows in such a manner that water flow is constricted by the nozzle.

21. The irrigation system of claim 13, wherein each of the flow control features comprises a deflector extending into the water in such a manner that the deflector does not, by itself, substantially constrict water flow.

22. The irrigation system of claim 13, further comprising a base unit comprising a garden hose coupling and a sprinkler coupling, wherein the garden hose coupling is designed to be connected to receive water from a standard garden hose and the sprinkler coupling is in fluid communication with the garden hose coupling and is connectable to the inlet coupling of the sprinkler.

23. The irrigation system of claim 22, further comprising a valve disposed upstream of the base unit and a timer electrically coupled to the valve to control water flow to the sprinkler.

24. A sprinkler for distributing water to soil, the sprinkler comprising:

an inlet coupling disposed to receive water from a source of pressurized water; and a head comprising a cover having an outlet aperture, the head further comprising a plurality of nozzles, each of which is movable into fluid communication with the outlet aperture to control distribution of water received through the inlet coupling to the soil through the outlet aperture, wherein the cover comprises a substantially tubular shape having an outer wall, wherein the outlet aperture is formed in the outer wall, wherein the head further comprises a flow control member comprising a substantially tubular shape comprising an outer wall in which the nozzles are formed, wherein the flow control member is rotatable about a generally vertical axis, wherein the head further comprises a dial extending from the flow control member, wherein the dial protrudes from the cover to permit rotation of the flow control member with respect to the cover via manual rotation of the dial;

wherein all of the nozzles are simultaneously in fluid communication with the inlet coupling; and wherein the nozzles are disposed within a chamber defined by the cover.

25. The sprinkler of claim 24, wherein the head further comprises a plenum chamber within the flow control member to provide continuous fluid communication between the nozzles and the inlet coupling.

26. The sprinkler of claim 24, wherein the plurality of nozzles comprises at least six nozzles comprising a plurality of differently-shaped orifices.

27. A sprinkler for distributing water to soil, the sprinkler comprising:

an inlet coupling disposed to receive water from a source of pressurized water;

a head comprising a cover having an outlet aperture, the head further comprising a plurality of flow control features, each of which is movable into fluid communication with the outlet aperture to control distribution of water received through the inlet coupling to the soil through the outlet aperture, the head further comprising a dial manually rotatable to move the flow control features into fluid communication with the outlet aperture; and a drive mechanism coupled to the cover to induce reversing rotation of the outlet aperture about a generally vertical axis through an angle of rotation;

wherein the dial extends outward with respect to the cover and is displaced from the flow control features toward the inlet coupling.

28. The sprinkler of claim 27, wherein the cover comprises a substantially flat plate in which the outlet aperture is formed, wherein the head further comprises a flow control member comprising a plurality of tubular extensions, each of which is disposed to convey water to one of the flow control features, wherein the flow control member is rotatable about the generally vertical axis to align any of the tubular extensions with the outlet aperture.

29. The sprinkler of claim 28, wherein each of the flow control features comprises a nozzle, wherein the head further comprises a deflector flow control member disposed outside the flow control member, wherein the deflector flow control member comprises an outer wall in which a plurality of deflectors are formed, wherein the deflector flow control member is rotatable about the generally vertical axis to align any of the deflectors with any of the nozzles.

30. The sprinkler of claim 28, wherein each of the flow control features comprises a nozzle, the head further comprising a cap disposed outside the flow control member, the cap comprising a generally frustoconical shape with an outer wall having a plurality of openings, each of which is aligned with one of the nozzles, wherein the nozzles are oriented to spray the water generally perpendicular to the outer wall.

31. The sprinkler of claim 30, wherein each of the nozzles is disposed substantially flush with the outer wall.

32. A sprinkler for distributing water to soil, the sprinkler comprising:

an inlet coupling disposed to receive water from a source of pressurized water;

a head comprising a cover having a substantially flat plate in which an outlet aperture is formed, the head further comprising a plurality of flow control features, each of which is movable into fluid communication with the outlet aperture to control distribution of water received through the inlet coupling to the soil through the outlet aperture, wherein the head further comprises a flow control member comprising a substantially flat plate adjacent to the substantially flat plate of the cover, and a plurality of tubular extensions extending from the substantially flat plate of the flow control member, wherein each of the tubular extensions is disposed to convey water to one of the flow control features, wherein the flow control member is rotatable about the generally vertical axis to align any of the tubular extensions with the outlet aperture; and a drive mechanism coupled to the cover to induce reversing rotation of the outlet aperture about a generally vertical axis through an angle of rotation.

33. The sprinkler of claim 32, wherein each of the flow control features comprises a nozzle, wherein the head further comprises a deflector flow control member disposed outside the flow control member, wherein the deflector flow control member comprises an outer wall in which a plurality of deflectors are formed, wherein the deflector flow control member is rotatable about the generally vertical axis to align any of the deflectors with any of the nozzles.

34. The sprinkler of claim 32, wherein each of the flow control features comprises a nozzle, the head further comprising a cap disposed outside the flow control member, the cap comprising a generally frustoconical shape with an outer wall having a plurality of openings, each of which is aligned with one of the nozzles, wherein the nozzles are oriented to spray the water generally perpendicular to the outer wall.

35. The sprinkler of claim 34, wherein each of the nozzles is disposed substantially flush with the outer wall.

36. A method for irrigating soil through the use of a sprinkler comprising an inlet coupling, a head comprising a plurality of flow control features and a cover having an outlet aperture, and a drive mechanism comprising a reduction gear train, the method comprising:

disposing one of the flow control features in fluid communication with the outlet aperture to provide a selected flow control feature;

receiving water from a source of pressurized water through the inlet coupling;

transmitting torque to the cover with a positive mechanical advantage via the gear train to induce oscillating rotation of the outlet aperture about a generally vertical axis, wherein the reduction gear train is exposed to the water received through the inlet coupling;

distributing the water to the soil through the outlet aperture along a spray pattern controlled by the selected flow control feature; and wherein the cover comprises a substantially flat plate in which the outlet aperture is formed, wherein the head further comprises a flow control member comprising a plurality of tubular extensions, each of which is disposed to convey water to one of the flow control features, wherein disposing one of the flow control features in fluid communication with the outlet aperture comprises rotating the flow control member about the generally vertical axis to align one of the tubular extensions with the outlet aperture.

37. The method of claim 36, wherein the flow control features are disposed within a chamber defined by the cover, wherein the cover comprises a substantially tubular shape having an outer wall, wherein the outlet aperture is formed in the outer wall, wherein the head further comprises a flow control member comprising a substantially tubular shape comprising an outer wall in which the flow control features are formed, wherein the flow control member is rotatable about the generally vertical axis, wherein the head further comprises a plenum chamber within the flow control member, the method further comprising inducing the water to flow through the plenum chamber to reach all of the flow control features.

38. The method of claim 36, wherein each of the flow control features comprises a nozzle, wherein the head further comprises a deflector flow control member disposed outside the flow control member, wherein the deflector flow control member comprises an outer wall in which a plurality of deflectors are formed, the method further comprising rotating the deflector flow control member about the generally vertical axis to align any of the deflectors with any of the nozzles.

39. The method of claim 36, wherein the plurality of flow control features comprises at least six flow control features comprising a plurality of differently-shaped orifices, wherein disposing one of the flow control features in fluid communication with the outlet aperture comprises rotating the flow control member with respect to the cover to dispose at least one of the orifices in fluid communication with the outlet aperture.

40. The method of claim 36, wherein the head further comprises a detent mechanism that urges the flow control features, collectively, to remain in any of a plurality of orientations, wherein in each of the orientations, one of the flow control features is disposed in fluid communication with the outlet aperture, wherein disposing one of the flow control features in fluid communication with the outlet aperture comprises overcoming a resistance provided by the detent mechanism to rotate the flow control features within the cover.

41. The method of claim 36, wherein the sprinkler further comprises a body that encases at least a portion of the drive mechanism, wherein the drive mechanism is coupled to first and second levers extending outward with respect to the body, the method further comprising moving the first lever with respect to the second lever to establish an angle through which the outlet aperture oscillates.

42. A method for irrigating soil through the use of a sprinkler comprising a body, an inlet coupling, a head comprising a plurality of flow control features, a cover having an outlet aperture, and a dial, the sprinkler further comprising drive mechanism comprising first and second levers, the method comprising:

relatively positioning the first and second levers to establish an angle of rotation of the cover, wherein the first and second levers extend outward with respect to the body and the body encases at least a portion of the drive mechanism;

manually rotating the dial to dispose one of the flow control features in fluid communication with the outlet aperture to provide a selected flow control feature, wherein the dial is axially offset from the flow control features;

receiving water from a source of pressurized water through the inlet coupling;

directing the water to flow through the drive mechanism to induce oscillating rotation of the outlet aperture about a generally vertical axis through the angle of rotation;

distributing the water to the soil through the outlet aperture along a spray pattern controlled by the selected flow control feature.

43. The method of claim 42, wherein the flow control features are disposed within a chamber defined by the cover, wherein the cover comprises a substantially tubular shape having an outer wall, wherein the outlet aperture is formed in the outer wall, wherein the head further comprises a flow control member comprising a substantially tubular shape comprising an outer wall in which the flow control features are formed, wherein the flow control member is rotatable about a generally vertical axis, wherein the head further comprises a plenum chamber within the flow control member, the method further comprising inducing the water to flow through the plenum chamber to reach all of the flow control features.

44. The method of claim 42, wherein the cover comprises a substantially flat plate in which the outlet aperture is formed, wherein the head further comprises a flow control member comprising a plurality of tubular extensions, each of which is disposed to convey water to one of the flow control features, wherein disposing one of the flow control features in fluid communication with the outlet aperture comprises rotating the flow control member about the generally vertical axis to align one of the tubular extensions with the outlet aperture.

45. The method of claim 44, wherein each of the flow control features comprises a nozzle, wherein the head further comprises a deflector flow control member disposed outside the flow control member, wherein the deflector flow control member comprises an outer wall in which a plurality of deflectors are formed, the method further comprising rotating the deflector flow control member about the generally vertical axis to align any of the deflectors with any of the nozzles.

46. The method of claim 44, wherein the plurality of flow control features comprises at least six flow control features comprising a plurality of differently-shaped orifices, wherein disposing one of the flow control features in fluid communication with the outlet aperture comprises rotating the flow control member with respect to the cover to dispose at least one of the orifices in fluid communication with the outlet aperture.

* * * * *